US009926879B2

(12) United States Patent
Nakano et al.

(10) Patent No.: US 9,926,879 B2
(45) Date of Patent: Mar. 27, 2018

(54) CONTROL APPARATUS FOR FUEL INJECTION VALVE AND METHOD THEREOF

(71) Applicants: Tomohiro Nakano, Nagoya (JP); Eiji Murase, Nagoya (JP); Rihito Kaneko, Miyoshi (JP)

(72) Inventors: Tomohiro Nakano, Nagoya (JP); Eiji Murase, Nagoya (JP); Rihito Kaneko, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 227 days.

(21) Appl. No.: 14/890,332

(22) PCT Filed: May 7, 2014

(86) PCT No.: PCT/IB2014/000686
§ 371 (c)(1),
(2) Date: Nov. 10, 2015

(87) PCT Pub. No.: WO2014/181166
PCT Pub. Date: Nov. 13, 2014

(65) Prior Publication Data

US 2016/0108847 A1 Apr. 21, 2016

(30) Foreign Application Priority Data

May 10, 2013 (JP) ..... 2013-100447

(51) Int. Cl.
*F02D 41/40* (2006.01)
*F02D 41/20* (2006.01)
(Continued)

(52) U.S. Cl.
CPC ..... *F02D 41/40* (2013.01); *F02D 41/20* (2013.01); *F02D 41/2467* (2013.01);
(Continued)

(58) Field of Classification Search
CPC ..... F02D 41/40; F02D 41/20; F02D 41/2467; F02D 2041/2058; F02D 2200/0602; F02D 2041/2055; F02M 63/0017; H01F 7/1844
See application file for complete search history.

(56) References Cited

U.S. PATENT DOCUMENTS 9,422,884 B2 * 8/2016 Fujii ..... F02D 41/247
2012/0116654 A1 5/2012 Toyohara et al.
2013/0139791 A1 * 6/2013 Kusakabe ..... F02D 41/20 123/478

FOREIGN PATENT DOCUMENTS

DE 102010022536 A1 12/2011
DE 102011004309 A1 8/2012
(Continued)

*Primary Examiner* — Hung Q Nguyen
*Assistant Examiner* — Xiao Mo
(74) *Attorney, Agent, or Firm* — Oliff PLC

(57) ABSTRACT

An electronic control unit that calculates an injection standby period, which is a period from an energization start point of the solenoid to a point at which the fuel injection valve opens, and adjusts an energization period of the solenoid in accordance with the calculated injection standby period. The electronic control unit of the control apparatus for a fuel injection valve then measures a reference fall detection period, which is a period from the energization start point to a reference fall detection point, and sets the injection standby period to be longer as the reference fall detection period is longer. Here, the reference fall detection point is a point at which the excitation current detected by the current detection circuit falls below a reference current value, which is smaller than a peak current value, while the excitation current decreases after reaching the peak current value.

17 Claims, 11 Drawing Sheets

(51) Int. Cl.

| | |
|---|---|
| ***F02D 41/24*** | (2006.01) |
| ***F02M 63/00*** | (2006.01) |
| *H01F 7/18* | (2006.01) |

(52) U.S. Cl.
CPC . *F02M 63/0017* (2013.01); *F02D 2041/2055* (2013.01); *F02D 2041/2058* (2013.01); *F02D 2200/0602* (2013.01); *H01F 7/1844* (2013.01)

(56) References Cited

FOREIGN PATENT DOCUMENTS

| | | | |
|---|---|---|---|
| EP | 0691464 | A2 | 1/1996 |
| JP | 2004251149 | A | 9/2004 |
| JP | 2007321582 | A | 12/2007 |
| JP | 2010265822 | A | 11/2010 |
| JP | 2012097693 | A | 5/2012 |

* cited by examiner

CONTROL APPARATUS FOR FUEL INJECTION VALVE AND METHOD THEREOF

BACKGROUND OF THE INVENTION

1. Field of the Invention

The invention relates to a control apparatus for a fuel injection valve, which performs opening and closing operations on a fuel injection valve provided in an internal combustion engine (an engine), and a method thereof.

2. Description of Related Art

An energization period of a fuel injection valve during a single fuel injection is separated into an opening period for opening the injection valve and a holding period for holding the injection valve in an open condition. During the opening period, power is supplied to a solenoid of the fuel injection valve from a capacitor capable of applying a higher voltage than a battery. During the opening period, therefore, an excitation current flowing in the solenoid is increased. In this case, an electromagnetic force generated by the fuel injection valve grows gradually stronger until the injection valve opens. When the excitation current reaches a peak current value set as a current value at which the fuel injection valve opens reliably, the opening period ends and the holding period begins. During the holding period, power is supplied to the solenoid of the fuel injection valve from the battery. During the holding period, therefore, the excitation current decreases rapidly from the peak current value and is held in the vicinity of a holding current value. In this case, the electromagnetic force generated by the fuel injection valve is held at a force required to hold the fuel injection valve in the open condition.

During the opening period, the electromagnetic force increases gradually as the excitation current flowing in the solenoid increases, and therefore the fuel injection valve actually opens after the elapse of a certain amount of time following a point at which energization of the solenoid is started. A period from the energization start point to the opening point at which the fuel injection valve actually opens is referred to as an "injection standby period". Further, a period from the energization start point to a point at which the fuel injection valve closes is referred to as an "effective injection period".

The effective injection period becomes steadily shorter as a required injection amount set in relation to a single fuel injection decreases. The injection standby period, in contrast to the effective injection period, is a period determined in accordance with an operating characteristic of the fuel injection valve at that time, and unlike the effective injection period, does not therefore vary in proportion to the required injection amount. Hence, when the required injection amount set in relation to a single fuel injection is small such that the energization period is short, the injection standby period occupies a larger proportion of the energization period. Accordingly, an effect of an estimation error of the injection standby period increases as the energization period of a single fuel injection shortens, and as a result, an actual fuel injection amount is more likely to diverge from the required injection amount.

When the actual injection amount is larger than the required injection amount, torque adjustment can be performed by adjusting an ignition timing or the like in order to reduce the generated torque. When the actual injection amount is smaller than the required injection amount, however, it is difficult to increase the torque. It is therefore necessary to estimate the injection standby period accurately to ensure that the actual injection amount does not fall below the required injection amount.

Japanese Patent Application Publication No. 2012-97693 (JP 2012-97693 A) discloses an example of a method of learning variation in the injection standby period. More specifically, a current waveform is selected in accordance with the required injection amount and so on, and the fuel injection valve is controlled on the basis of the selected current waveform. When a condition for learning the variation in the injection standby period is established during a fuel injection, the variation in the injection standby period is learned using the current waveform selected to control the fuel injection valve as a parameter.

Note that the injection standby period may be estimated using a method of detecting an increase gradient of the excitation current on which the excitation current increases to the peak current value during the opening period, and setting the injection standby period to be steadily longer as the increase gradient becomes gentler.

SUMMARY OF THE INVENTION

In the method of estimating the injection standby period on the basis of the increase gradient of the excitation current during the opening period, a current detection circuit is used to monitor the excitation current. A precision with which the current detection circuit detects the excitation current varies according to individual differences occurring during manufacture of the current detection circuit, variation over time, an atmospheric temperature during use, and so on. With this estimation method, therefore, it cannot easily be said that the estimation precision of the injection standby period is high.

An object of the invention is to provide a control apparatus for a fuel injection valve and a method thereof, with which an injection standby period can be calculated with a high degree of precision.

According to an aspect of the invention, a control apparatus for a fuel injection valve includes: a drive control unit that controls an opening and closing operation of the fuel injection valve by causing an excitation current to flow in a solenoid of the fuel injection valve; a current detection circuit that detects the excitation current flowing in the solenoid; and an electronic control unit. The electronic control unit calculates an injection standby period, which is a period from an energization start point of the solenoid to a point at which the fuel injection valve opens, and adjusts an energization period of the solenoid in accordance with the calculated injection standby period. The electronic control unit of the control apparatus for a fuel injection valve then measures a reference fall detection period, which is a period from the energization start point to a reference fall detection point, and sets the injection standby period to be longer as the reference fall detection period is longer. Here, the reference fall detection point is a point at which the excitation current detected by the current detection circuit falls below a reference current value, which is smaller than a peak current value, while decreasing after reaching the peak current value.

The injection standby period can be estimated to increase in length as an excitation current increase speed, at which the excitation current increases, becomes lower. The reason for this is that an electromagnetic force generated by the fuel injection valve increases more gently. Further, since the fuel injection valve is in an open condition, when the excitation current reaches the set peak current value, the excitation current is reduced to the vicinity of a holding current value. An excitation current decrease speed at this time is higher than the excitation current increase speed at which the excitation current increases to the peak current value. In other words, when the excitation current decreases from the peak current value, the excitation current varies rapidly. Hence, even when the detected current value varies irregularly due to individual differences occurring during manufacture of the current detection circuit, deterioration thereof over time, the atmospheric temperature during use, and so on, the reference fall detection period is less likely to be affected by the variation than a period from the energization start point to a reference rise detection point. Note that the "reference rise detection point" is a point at which the excitation current detected by the current detection circuit exceeds the reference current value while increasing toward the peak current value.

According to the configuration described above, the injection standby period is set to be longer as the reference fall detection period is longer. In other words, the injection standby period is calculated on the basis of the reference fall detection period, which is less likely to be affected by variation in the current value detected by the current detection circuit. As a result, the injection standby period can be calculated with a high degree of precision.

Further, according to the aspect of the invention, the electronic control unit may measure a reference rise detection period, which is a period from the energization start point to the reference rise detection point, and calculate a reference rise calculation period, which is a calculated value of the period from the energization start point to the reference rise detection point, by multiplying a reference conversion coefficient by the reference fall detection period. The electronic control unit may then increase a reference fall variation ratio steadily as a reference rise variation ratio, which is a quotient obtained by dividing the reference rise calculation period by the reference rise detection period, increases. Further, the electronic control unit may calculate a reference fall calculation period by multiplying the reference fall variation ratio by the reference fall detection period, and set the injection standby period to be longer as the reference fall calculation period is longer.

When the peak current value remains fixed, the excitation current increase speed at which the excitation current increases toward the peak current value and the excitation current decrease speed at which the excitation current decreases from the peak current value have a constant correlative relationship. Therefore, the reference rise calculation period can be calculated by multiplying a reference conversion coefficient corresponding to the correlative relationship between the increase speed and the decrease speed of the excitation current by the reference fall detection period. The reference rise calculation period is a value calculated on the basis of the reference fall detection period. The reference fall detection period is less likely to be affected by variation in the current value detected by the current detection circuit than the reference rise detection period. Accordingly, the calculated reference rise calculation period is less likely to be affected by variation than the reference rise detection period.

The reference rise variation ratio and the reference fall variation ratio are both values indicating a degree of variation in the current value detected by the current detection circuit. The reference rise variation ratio is a variation ratio between the reference rise calculation period and the reference rise detection period. The reference fall variation ratio is a variation ratio between the reference fall calculation period and the reference fall detection period. Hence, the reference fall variation ratio and the reference rise variation ratio have a fixed correlative relationship, and therefore the reference fall variation ratio can be calculated from the reference rise variation ratio. By multiplying the reference fall variation ratio calculated from the reference rise variation ratio by the reference fall detection period, the reference fall calculation period can be calculated. The reference fall calculation period takes into account the degree of variation in the current value detected by the current detection circuit, and is therefore a more precise value than the reference fall detection period. Hence, by calculating the injection standby period on the basis of the reference fall calculation period, a calculation precision of the injection standby period can be improved.

Further, a point at which the excitation current detected by the current detection circuit reaches or exceeds a learning current value, which is smaller than the reference current value, while increasing toward the peak current value is set as a learned rise detection point. In this case, the electronic control unit of the control apparatus for a fuel injection valve may measure a learned rise detection period, which is a period from the energization start point to the learned rise detection point. The electronic control unit may then calculate a learned rise calculation period, which is a calculated value of the period from the energization start point to the learned rise detection point, by multiplying a learning conversion coefficient by the reference fall calculation period. Furthermore, the electronic control unit may calculate a variation ratio learned value by dividing the calculated learned rise calculation period by the learned rise detection period, measure the learned rise detection period during a fuel injection, and set the injection standby period to be longer as a product obtained by multiplying the variation ratio learned value by the measured learned rise detection period increases.

As described above, when the peak current value remains fixed, the excitation current increase speed at which the excitation current increases toward the peak current value and the excitation current decrease speed at which the excitation current decreases from the peak current value have a constant correlative relationship. Hence, according to the configuration described above, the variation ratio learned value is calculated by multiplying a learning conversion coefficient corresponding to the correlative relationship between the increase speed and the decrease speed of the excitation current by the reference fall calculation period in order to calculate the learned rise calculation period. In other words, the variation ratio learned value is calculated as a variation ratio between the learned rise detection period and the learned rise calculation period. The learned rise calculation period, which is the period from the energization start point to the learned rise detection point, is then measured, whereupon the injection standby period is calculated in accordance with a product obtained by multiplying the variation ratio learned value by the learned rise detection period. According to the configuration described above, in other words, the injection standby period relating to the fuel injection is calculated at the point where the excitation current reaches the learning current value. Therefore, the injection standby period can be calculated appropriately, and the energization period can be adjusted appropriately, even during a short fuel injection in which energization is terminated before the excitation current reaches the peak current value.

Note that when energization of the fuel injection valve is terminated before the excitation current reaches the peak current value, the reference fall detection period cannot be detected. Accordingly, the variation ratio learned value cannot be calculated appropriately, and as a result, the calculation precision of the variation ratio learned value may decrease. Hence, according to the aspect of the invention, the electronic control unit may be prevented from calculating the variation ratio learned value when energization of the fuel injection valve is terminated before the excitation current detected by the current detection circuit reaches the peak current value. According to this configuration, the variation ratio learned value is not calculated when the calculation precision of the variation ratio learned value decreases. Accordingly, the injection standby period is less likely to be calculated using an imprecise variation ratio learned value, and as a result, a reduction in the calculation precision of the injection standby period can be suppressed.

Further, according to the aspect of the invention, the electronic control unit may set a period corresponding to an energization period required for the excitation current to reach the peak current value as a predetermined period, and determine that energization has been terminated before the excitation current has reached the peak current value when the energization period is shorter than the predetermined period. When the energization period set in relation to the fuel injection valve is shorter than the predetermined period, energization of the fuel injection valve may be terminated before the excitation current detected by the current detection circuit reaches the peak current value. Hence, a configuration whereby the variation ratio learned value is not calculated in such a case may be employed.

Further, according to the aspect of the invention, a quotient obtained by dividing a central characteristic value of the learned rise detection period by a minimum measurable value of the learned rise detection period may be set as an initial value of the variation ratio learned value. Furthermore, when calculation of the variation ratio learned value is not complete, the electronic control unit may set the injection standby period to be longer as a product obtained by multiplying the initial value of the variation ratio learned value by the learned rise detection period increases.

The learned rise detection period may vary between a maximum value and a minimum value, which are determined by a magnitude of possible variation in a detection value of the excitation current due to the current detection circuit. The learned rise calculation period, on the other hand, is less likely to vary than the learned rise detection period, and can only vary in the vicinity of the central characteristic value between the maximum value and the minimum value. Hence, the initial value of the variation ratio learned value is calculated using the method described above, in which the quotient obtained by dividing the central characteristic value by the minimum value, which is furthest removed from the central characteristic value, is set as the initial value. When the initial value of the variation ratio learned value is calculated in this manner, the calculated initial value takes an extremely large value within a calculable range. Therefore, the injection standby period calculated using the initial value of the variation ratio learned value is slightly longer than an actual injection standby period. As a result, by setting the initial value of the variation ratio learned value in the manner described above, a situation in which an actual amount of injected fuel falls below a required injection amount before calculation of the variation ratio learned value is complete can be suppressed.

Further, according to the aspect of the invention, the electronic control unit may, after the variation ratio learned value has been calculated, cause the value that is multiplied by the learned rise detection period when determining the injection standby period to approach the variation ratio learned value from the initial value of the variation ratio learned value gradually every time fuel is injected from the fuel injection valve. According to this configuration, when calculation of the variation ratio learned value is complete, the injection standby period approaches an appropriate value gradually every time fuel is injected from the fuel injection valve. Therefore, when a difference between the initial value of the variation ratio learned value and the calculated variation ratio learned value is large, the injection standby period is modified gradually. As a result, rapid variation in the fuel injection amount during a switch in the variation ratio learned value from the initial value to the calculated value can be suppressed.

Further, according to the aspect of the invention, when an operating condition of an internal combustion engine (an engine) shifts from an injection prohibited condition, in which fuel injection by the fuel injection valve is prohibited, to an injection permitted condition, in which fuel injection is performed by the fuel injection valve, the electronic control unit preferably calculates a product by multiplying the variation ratio learned value by the last learned rise detection period to be calculated when the operating condition of the internal combustion engine (the engine) was previously in the injection permitted condition, and sets the injection standby period to be longer as a value obtained by adding a temperature correction value to the product increases.

When fuel injection by the fuel injection valve is prohibited, a cooling action that accompanies the fuel injection does not occur, and therefore a temperature of the fuel injection valve may increase. In this case, a resistance value of the solenoid of the fuel injection valve increases such that the fuel injection valve opens less easily. Hence, according to the configuration described above, when the operating condition of the internal combustion engine (the engine) shifts from the injection prohibited condition to the injection permitted condition, a product is calculated by multiplying the variation ratio learned value by the last learned rise detection period to be detected when the operating condition of the internal combustion engine (the engine) was previously in the injection permitted condition, whereupon the injection standby period is calculated on the basis of the value obtained by adding the temperature correction value to the calculated product. Therefore, during a fuel injection performed immediately after a shift to the injection permitted condition, the injection standby period can be calculated while taking into account the temperature increase that occurred in the fuel injection valve while fuel injection was prohibited, even though the excitation current has not been detected by the current detection circuit.

Note that when a temperature correction value is used to calculate the injection standby period, as described above, the temperature correction value may be set to increase as an amount by which the temperature of the fuel injection valve increased while the internal combustion engine (the engine) was in the injection prohibited condition increases. According to this configuration, the injection standby period is lengthened as the temperature increase amount increases such that the fuel injection valve opens less easily. As a result, the injection standby period can be calculated in accordance with variation in an opening characteristic of the fuel injection valve corresponding to the temperature increase.

Furthermore, according to the aspect of the invention, the electronic control unit may calculate the variation ratio learned value when an engine temperature is included in a temperature range. The resistance value of the solenoid of the fuel injection valve varies according to a temperature of the solenoid, and therefore an injection characteristic of the fuel injection valve may vary according to a temperature of a disposal environment of the fuel injection valve. In other words, when the variation ratio learned value is calculated under various conditions having different disposal environment temperatures, the variation ratio learned value varies according to the disposal environment temperature at the time of calculation. According to the configuration described above, therefore, the variation ratio learned value is calculated only when the engine temperature is included in the temperature range. Hence, variation in the variation ratio learned value due to the temperature of the disposal environment of the fuel injection valve can be suppressed in comparison with a case where calculation of the variation ratio learned value is permitted both when the engine temperature is included in the temperature range and when the engine temperature is not included in the temperature range. According to the configuration described above, therefore, the injection standby period is calculated using a variation ratio learned value in which variation due to the disposal environment temperature has been suppressed, and as a result, the calculation precision can be improved.

When a large amount of time has not yet elapsed following engine startup, the engine temperature remains in the vicinity of an outside air temperature, and therefore the engine temperature is likely to be included in a fixed temperature range from which the outside air temperature can be obtained. Hence, by calculating the injection standby period using a variation ratio learned value in which variation due to the disposal environment temperature has been suppressed likewise when an attempt is made to calculate the variation ratio learned value before a fixed period of time has elapsed following engine startup, the calculation precision can be improved.

Furthermore, according to the aspect of the invention, the drive control unit may supply power to the solenoid from a capacitor that is capable of applying a higher voltage than a battery from the energization start point to a point at which the excitation current reaches the peak current value. Further, the electronic control unit may shorten the learned rise calculation period as a voltage of the capacitor at the energization start point decreases, and calculate the variation ratio learned value using the learned rise calculation period.

In a case where an interval between fuel injections is short or the like, a subsequent fuel injection may be started before the voltage of the capacitor has recovered sufficiently. In this case, the voltage of the capacitor is lower than an upper limit voltage determined in accordance with a capacity of the capacitor. As a result, the increase speed of the excitation current from the energization start point is more likely to be low than when the voltage of the capacitor is at the upper limit voltage. The learned rise calculation period calculated using the reference rise detection period and so on measured under these conditions is longer than the learned rise calculation period calculated when the voltage of the capacitor is at the upper limit voltage. When the variation ratio learned value is calculated using the learned rise calculation period calculated during a fuel injection performed in a condition where the voltage of the capacitor is lower than the upper limit voltage, the variation ratio learned value is affected by the reduction in the voltage of the capacitor.

According to the configuration described above, on the other hand, the learned rise calculation period is shortened as the voltage of the capacitor at the energization start point decreases, whereupon the variation ratio learned value is calculated using the learned rise calculation period thus corrected. As a result, the variation ratio learned value can be calculated while minimizing the effect of the voltage of the capacitor, and by calculating the injection standby period using this variation ratio learned value, a reduction in the calculation precision can be suppressed.

Further, according to the aspect of the invention, the electronic control unit may, when the learned rise detection period is not included in an allowable range, calculate a product by multiplying the variation ratio learned value by the learned rise detection period measured during a previous fuel injection, and set the injection standby period to be longer as a value obtained by adding an abnormality determination correction value to the calculated product increases.

When the learned rise detection period is too short or too long, this may indicate an abnormal condition in which the learned rise detection period cannot be measured accurately. When a product is calculated by multiplying the variation ratio learned value by the learned rise detection period measured in the abnormal condition and the injection standby period is calculated on the basis of the calculated product, the calculated injection standby period may be shorter than the actual injection standby period. Hence, according to the configuration described above, when the measured learned rise detection period is not within the allowable range, a product is calculated by multiplying the variation ratio learned value by the learned rise detection period measured during the previous fuel injection, and the injection standby period is calculated on the basis of the value obtained by adding the abnormality determination correction value to the calculated product. Note that a magnitude of the abnormality determination correction value is set such that the injection standby period calculated according to this method is longer than the actual injection standby period. According to the configuration described above, therefore, the injection standby period can be made longer than the actual injection standby period, and as a result, the actual fuel injection amount can be prevented from falling below the required injection amount.

Furthermore, according to an aspect of the invention, the electronic control unit may, when a difference between the reference rise detection period and the reference fall detection period is equal to or smaller than a determination value, calculate the variation ratio learned value using the reference rise calculation period used to calculate the previous variation ratio learned value and the reference fall calculation period used to calculate the previous variation ratio learned value.

When the difference between the reference rise detection period and the reference fall detection period is equal to or smaller than the determination value, this may indicate an erroneous detection caused by noise or the like. Hence, according to the configuration described above, when the difference between the reference rise detection period and the reference fall detection period is smaller than the determination value, the current variation ratio learned value is calculated using the previous reference rise calculation period and the previous reference fall calculation period. At this time, the respective calculation periods calculated using the respective detection periods are not used. As a result, an increase in a deviation between the calculated injection standby period and the actual, injection standby period due to an effect of an erroneous detection caused by noise or the like can be suppressed.

Furthermore, according to the aspect of the invention, a fuel pressure in a delivery pipe at a point where fuel is injected from the fuel injection valve may be set as an injection fuel pressure, and the electronic control unit may set the injection standby period to be longer as the injection fuel pressure increases.

As the fuel pressure in the delivery pipe increases, the fuel injection valve opens less easily. According to the configuration described above, however, the injection standby period is set to be longer as the fuel pressure in the delivery pipe increases such that the fuel injection valve opens less easily. As a result, the injection standby period can be calculated in accordance with an opening characteristic of the fuel injection valve corresponding to variation in the fuel pressure in the delivery pipe.

Note that the injection fuel pressure may take a value obtained by adding a fuel pressure increase amount to a fuel pressure sensor value detected by a fuel pressure sensor. The fuel pressure increases steadily as an amount of fuel discharged from a fuel pump over a period from a detection point of the fuel pressure sensor value to the energization start point increases. According to this configuration, the injection fuel pressure can be calculated with a high degree of precision, taking into account the increase in the fuel pressure over the period from the detection point of the fuel pressure sensor value by the fuel pressure sensor to the energization start point, even when a fuel injection is performed in an interval between fuel pressure detection periods of the fuel pressure sensor. As a result, the calculation precision of the injection standby period can be improved.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
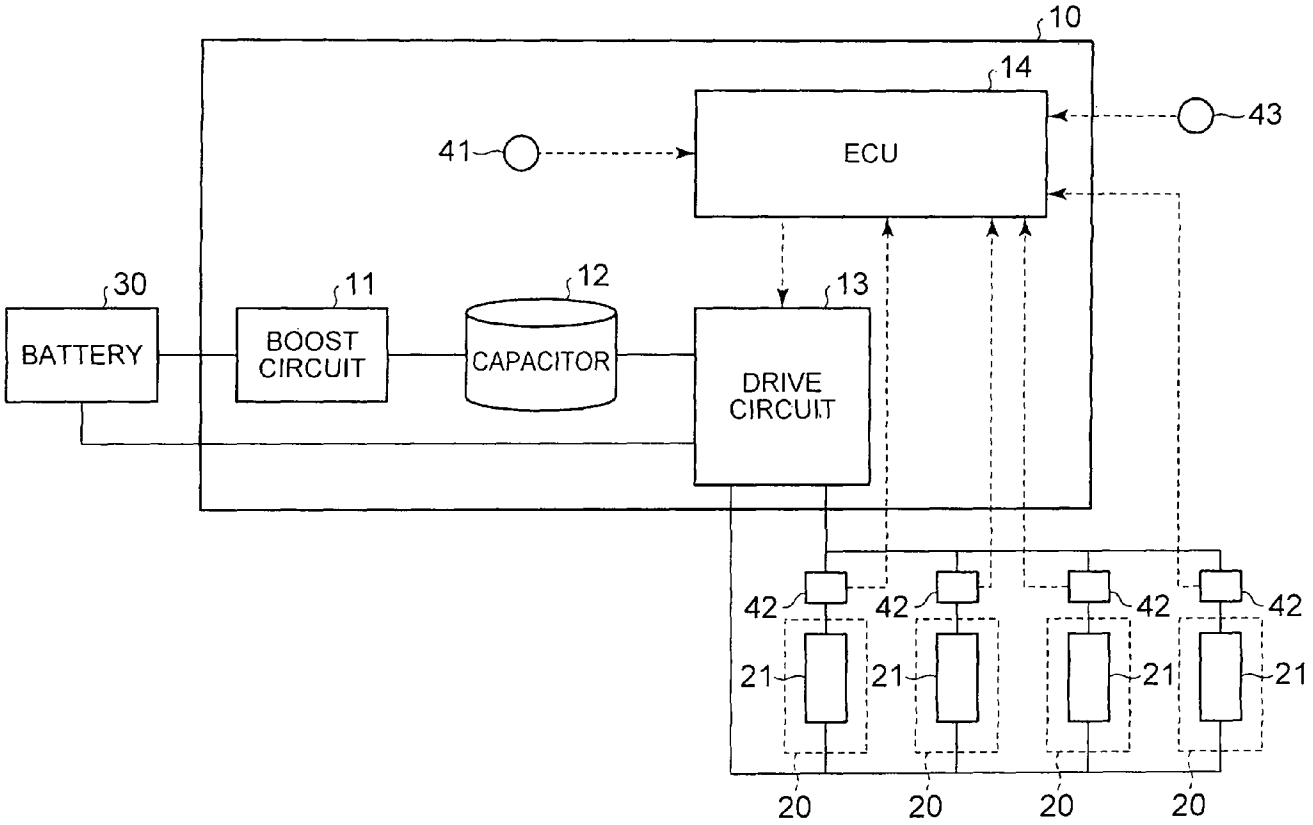
FIG. 1 is a schematic diagram showing configurations of a control apparatus for a fuel injection valve according to an embodiment and a plurality of fuel injection valves controlled by the control apparatus.

Referring to FIGS. 1 to 16, a specific embodiment of a control apparatus for a fuel injection valve, which operates a fuel injection valve provided in an internal combustion engine (an engine) to open and close, will be described below. FIG. 1 shows a control apparatus 10 for a fuel injection valve according to this embodiment, and a plurality of fuel injection valves 20 (four here) controlled by the control apparatus 10. The fuel injection valves 20 are respectively constituted by injection valves for direct injection that inject fuel directly into a combustion chamber of the internal combustion engine (the engine).

As shown in FIG. 1, the control apparatus 10 includes a boost circuit 11 that boosts a voltage of a battery 30 provided in a vehicle, a capacitor 12 charged with the voltage boosted by the boost circuit 11, and a drive circuit 13 serving as a drive control unit. The drive circuit 13 drives the fuel injection valves 20 using the capacitor 12 and the battery 30 separately as a power supply under the control of a functioning electronic control unit (referred to hereafter as an "ECU") 14.

The ECU 14 includes a microcomputer constructed from a central processing unit (CPU), a read only memory (ROM), a random access memory (RAM), and so on. Various control programs and the like executed by the CPU are stored in the ROM in advance. Information that is updated as appropriate is stored in the RAM.

Further, various detection systems are electrically connected to the ECU 14. The various detection systems include a voltage sensor 41, a current detection circuit 42, a fuel pressure sensor 43, and so on. The voltage sensor 41 detects a capacitor voltage Vc serving as a voltage of the capacitor 12. The current detection circuit 42 detects an excitation current Iinj that flows in a solenoid 21 of the fuel injection valve 20. The fuel pressure sensor 43 detects a fuel pressure in a delivery pipe provided in a fuel supply system that supplies fuel to the fuel injection valve 20. The control apparatus 10 including the ECU 14 controls the respective fuel injection valves 20 on the basis of information detected by the various detection systems.

Figure 2:
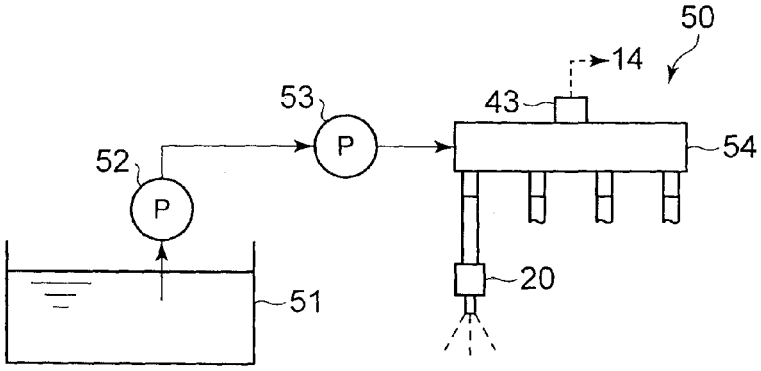
FIG. 2 is a schematic diagram showing a configuration of a fuel supply system for supplying fuel to the fuel injection valve.

Next, referring to FIG. 2, a fuel supply system 50 for supplying fuel to the fuel injection valves 20 will be described. As shown in FIG. 2, the fuel supply system 50 is provided with a low pressure fuel pump 52 that draws fuel from a fuel tank 51 storing the fuel, a high pressure fuel pump 53 that pressurizes fuel discharged from the low pressure fuel pump 52 to a predetermined fuel pressure and then discharges the pressurized fuel, and a delivery pipe 54 in which the high pressure fuel discharged from the high pressure fuel pump 53 is stored. The fuel in the delivery pipe 54 is supplied to the fuel injection valves 20.

Figure 3:
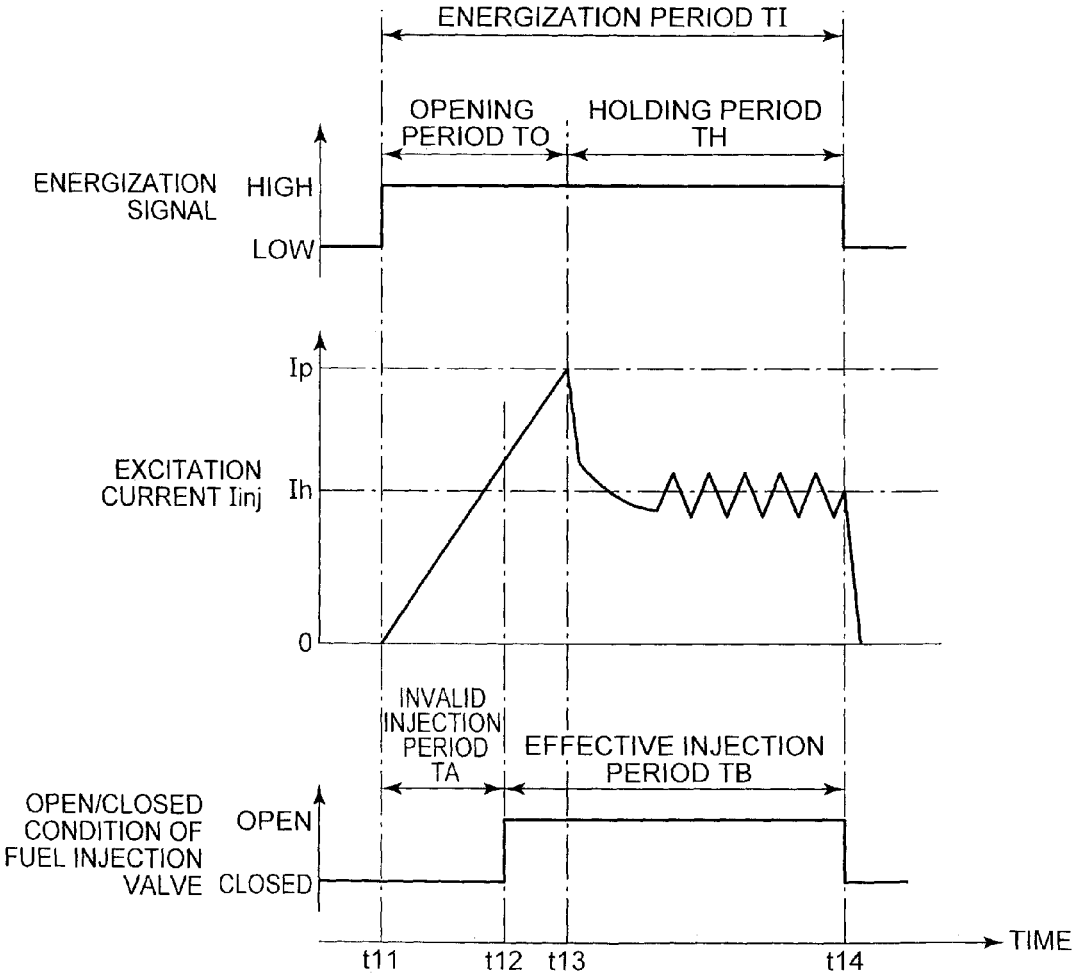
FIG. 3 is an example of a timing chart of a case in which fuel is injected from the fuel injection valve, showing, in descending order, transitions of a level of an energization signal output from an ECU to a drive circuit, transitions of an excitation current flowing in a solenoid of the fuel injection valve, and transitions of an open and close condition of the fuel injection valve.

Next, referring to FIG. 3, a manner in which power is supplied to the fuel injection valve 20 will be described. As shown in FIG. 3, when a level of an energization signal output from the ECU 14 to the drive circuit 13 switches from "Low" to "High", the excitation current Iinj starts to flow in the solenoid 21 of the fuel injection valve 20. In other words, a period from a first timing t11 at which the level of the energization signal switches from "Low" to "High" to a fourth timing t14 at which the level of the energization signal switches from "High" to "Low" corresponds to an energization period TI during which the fuel injection valve 20 is energized.

At the first timing t11 serving as an energization start point at which energization of the fuel injection valve 20 begins, the fuel injection valve 20 is closed. Here, to open the fuel injection valve 20, power is supplied to the fuel injection valve 20 using the capacitor 12, which is capable of applying a higher voltage than the battery 30, as the power supply. In this case, the excitation current Iinj flowing in the solenoid 21 gradually increases, and therefore an electromagnetic force generated by the solenoid 21 also increases gradually. At a second timing t12 occurring as the excitation current Iinj increases, the fuel injection valve 20 opens, whereupon fuel is injected from the fuel injection valve 20.

A period from the first timing t11 to the second timing t12 corresponds to an injection invalid period TA. The injection invalid period TA is an injection standby period in which energization of the fuel injection valve 20 has started but fuel has not yet been injected from the fuel injection valve 20. Further, a period from the second timing t12 to the fourth timing t14 at which energization of the fuel injection valve 20 is terminated corresponds to an effective injection period TB. During the effective injection period TB, fuel is actually injected from the fuel injection valve 20.

When, at a third timing t13 following the second timing t12, the excitation current Iinj flowing in the solenoid 21 reaches a peak current value Ip set as a current value required to open the fuel injection valve reliably, an opening period TO for opening the fuel injection valve 20 ends. When the opening period TO ends, a holding period TH for holding the fuel injection valve 20 in an open condition begins. Accordingly, the power supply is switched by the drive circuit 13 from the capacitor 12 to the battery 30 such that the voltage applied to the solenoid 21 of the fuel injection valve 20 decreases, and as a result, the excitation current Iinj decreases rapidly. A reduction speed of the excitation current Iinj at this time is much higher than an increase speed at which the excitation current Iinj increases toward the peak current value Ip. In other words, when the excitation current Iinj decreases from the peak current value Ip, the excitation current varies rapidly.

The excitation current Iinj decreasing from the peak current value Ip is regulated to the vicinity of a predetermined holding current value Ih at which a sufficient amount of electromagnetic force for holding the fuel injection valve 20 in the open condition is generated by the solenoid 21. When the energization signal switches from "High" to "Low" at the fourth timing t14 thereafter, energization of the fuel injection valve 20 is terminated, and as a result, the fuel injection valve 20 closes.

The energization period TI is determined by a required injection amount set in relation to a single fuel injection, and therefore the energization period TI shortens as the required injection amount decreases. In other words, when the required injection amount is small, energization of the fuel injection valve 20 may be terminated during the opening period TO in which the fuel injection valve 20 is energized by the capacitor 12.

The effective injection period TB, incidentally, is set to be steadily longer as the required injection amount set in relation to a single fuel injection increases. The injection invalid period TA is determined relative to the set effective injection period TB in accordance with a characteristic of the fuel injection valve 20 at that time. To cause the fuel injection valve 20 to inject an appropriate amount of fuel corresponding to the required fuel amount, therefore, the injection invalid period TA must be set appropriately, whereupon the energization period TI may be calculated by adding the effective injection period TB corresponding to the required fuel amount to the injection invalid period TA.

Figure 4:
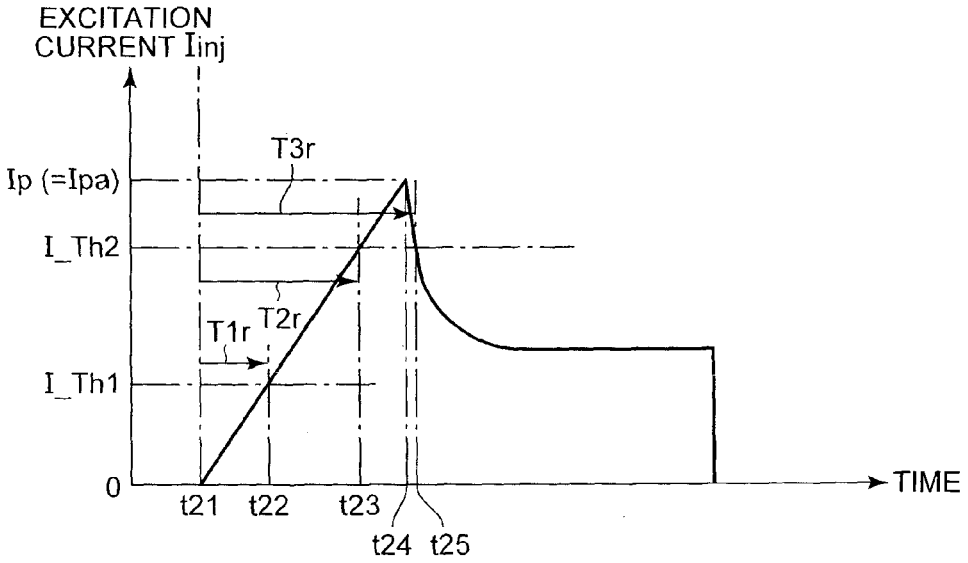
FIG. 4 is a timing chart showing variation in the excitation current flowing in the solenoid when fuel is injected from the fuel injection valve.

Next, referring to FIG. 4, an outline of a method of calculating the injection invalid period TA will be described. FIG. 4 shows an outline of transitions of the excitation current Iinj that flows in the solenoid 21 when the fuel injection valve 20 is caused to inject fuel in a condition where the peak current value Ip is set at a predetermined peak set value Ipa.

Note that in the following description, a point during the increasing process of the excitation current Iinj at which the excitation current Iinj exceeds a learning current value I_Th1, which is smaller than the peak set value Ipa, is referred to as a "learned rise detection point t22". Further, a point at which the excitation current Iinj exceeds a reference current value I_Th2, which is smaller than the peak set value Ipa but larger than the learning current value I_Th1, is referred to as a "reference rise detection point t23". A point at which the excitation current Iinj reaches the peak current value Ip is referred to as a "peak arrival point t24", and a point during the decreasing process of the excitation current Iinj from the peak current value Ip at which the excitation current Iinj falls below the reference current value I_Th2 is referred to as a "reference fall detection point t25".

In the control apparatus 10 for a fuel injection valve according to this embodiment, the injection invalid period TA of a current fuel injection is determined at the learned rise detection point t22. The electromagnetic force generated by the solenoid 21 of the fuel injection valve 20 increases in strength steadily more slowly as the increase speed of the excitation current Iinj from the energization start point t21 decreases, and therefore the fuel injection valve 20 opens less easily, leading to an increase in the length of the injection invalid period TA. In other words, as the increase speed of the excitation current Iinj from the energization start point t21 decreases, a learned rise detection period T1r, which is a period from the energization start point t21 to the learned rise detection point t22, is longer. Hence, the injection invalid period TA can be estimated on the basis of the learned rise detection period T1r.

However, the excitation current Iinj detected by the current detection circuit 42 includes a current value detection error generated by the current detection circuit 42. Moreover, the detection error may vary according to individual differences occurring during circuit manufacture, characteristic variation over time, and a temperature of a disposal environment during use. In other words, variation occurs in the measured learned rise detection period T1r due to the current value detection error generated by the current detection circuit 42. To calculate the injection invalid period TA accurately, therefore, it is preferable to calculate a value obtained by excluding an effect of variation in the current value detected by the current detection circuit 42 from the measured learned rise detection period T1r, and then calculate the injection invalid period TA using this calculated value.

In the control apparatus 10 for a fuel injection valve according to this embodiment, a variation ratio learned value Rc is calculated as a variation ratio of the learned rise detection period T1r that may occur due to variation in the current value detected by the current detection circuit 42. The variation ratio learned value Rc is calculated for each fuel injection valve 20. During fuel injection after calculation of the variation ratio learned value Rc is complete, a learned calculation period T4c is calculated by multiplying the variation ratio learned value Rc by the learned rise detection period T1r measured during the opening period TO, and the injection invalid period TA is set to be steadily longer as the learned calculation period T4c increases.

Note that even when the required injection amount set in relation to the fuel injection valve 20 is a minimum injection amount of the fuel injection valve 20, the learning current value I_Th1 is set such that the excitation current Iinj can always exceed the learning current value I_Th1. In other words, during energization of the fuel injection valve 20 serving as a fuel injection subject, energization of the fuel injection valve 20 is not terminated before the excitation current Iinj reaches the learning current value I_Th1. Hence, during a fuel injection performed in a condition where calculation of the variation ratio learned value Rc is complete, the learned calculation period T4c can be calculated reliably, and therefore the injection invalid period TA can be calculated using the learned calculation period T4c.

Further, the variation ratio learned value Rc is calculated only during a fuel injection in which the peak current value Ip is set at the predetermined peak set value Ipa. In other words, the variation ratio learned value Rc is not calculated during a fuel injection in which the peak current value Ip is set at a different value to the peak set value Ipa. During a fuel injection in which the variation ratio learned value Rc is calculated, following detection periods T1r, T2r, T3r are measured: the learned rise detection period T1r, which is a measured value of the period from the energization start point t21 to the learned rise detection point t22; a reference rise detection period T2r, which is a measured value of a period from the energization start point t21 to a reference rise detection point t23; and a reference fall detection period T3r, which is a measured value of a period from the energization start point t21 to a reference fall detection point t25.

Further, during a fuel injection in which the variation ratio learned value Rc is calculated, following calculation periods T1c, T2c, T3c are calculated: a learned rise calculation period T1c, which is a calculated value of the period from the energization start point t21 to the learned rise detection point t22; a reference rise calculation period T2c, which is a calculated value of the period from the energization start point t21 to the reference rise detection point t23; and a reference fall calculation period T3c, which is a calculated value of the period from the energization start point t21 to the reference fall detection point t25.

The variation ratio learned value Rc is then calculated on the basis of the respective detection periods T1r to T3r and the respective calculation periods T1c to T3c. Next, referring to a flowchart shown in FIG. 5, a processing routine executed by the ECU 14 to set the energization period TI of the fuel injection valves 20 during a single fuel injection will be described. Here, a processing routine that starts when energization of one of the plurality of fuel injection valves 20 begins will be described. Note, however, that a similar processing routine to this processing routine is started likewise when energization of another fuel injection valve 20 begins.

Figure 5:
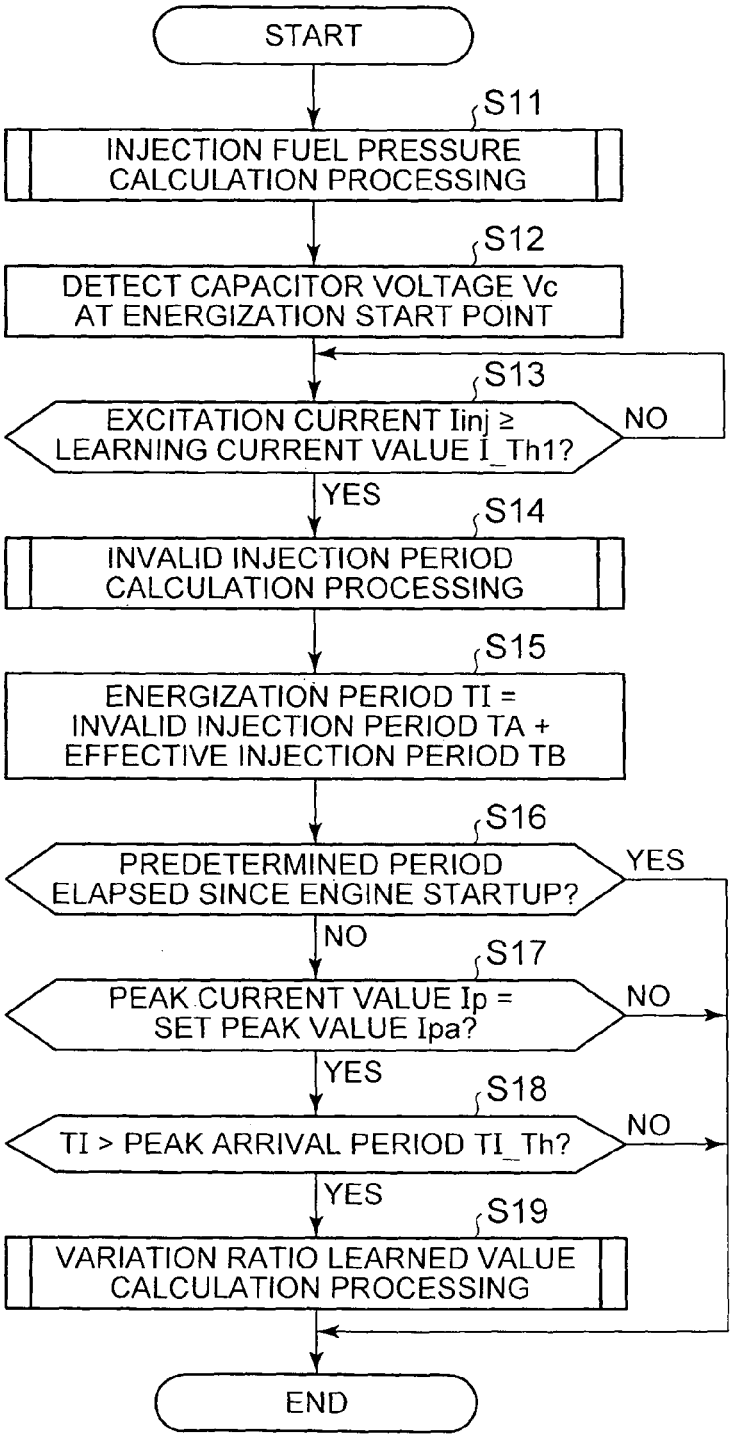
FIG. 5 is a flowchart illustrating a processing routine executed by the control apparatus for a fuel injection valve according to this embodiment when fuel is injected from the fuel injection valve.

In this processing routine, as shown in FIG. 5, the ECU 14 performs calculation processing to calculate an injection fuel pressure Pinj, which is a fuel pressure in the delivery pipe 54 at the energization start point (step S11). The fuel injection valve 20 opens less easily as the fuel pressure in the delivery pipe 54 increases. As a result, the injection invalid period TA is more likely to increase in length as the fuel pressure in the delivery pipe 54 increases. In step S11, therefore, the injection fuel pressure Pinj is calculated in order to calculate the injection invalid period TA while taking the injection fuel pressure Pinj into account. Note that processing for calculating the injection fuel pressure will be described below with reference to FIG. 6.

Next, the ECU 14 detects the capacitor voltage Vc at the energization start point (step S12). The increase speed of the excitation current Iinj from the energization start point decreases more easily as the capacitor voltage Vc decreases. Hence, the capacitor voltage Vc at the energization start point is calculated in step S12 in order to calculate the variation ratio learned value Rc while minimizing an effect of a magnitude of the capacitor voltage Vc at the energization start point.

The ECU 14 then determines whether or not the excitation current Iinj detected by the current detection circuit 42 equals or exceeds the learning current value I_Th1 (step S13). When the excitation current Iinj is smaller than the learning current value I_Th1 (step S13: NO), the ECU 14 executes the determination processing of step S13 repeatedly until the excitation current Iinj equals or exceeds the learning current value I_Th1. When the excitation current Iinj equals or exceeds the learning current value I_Th1 (step S13: YES), or in other words when the excitation current Iinj has reached the learned rise detection point, the ECU 14 performs processing to calculate the injection invalid period TA, as will be described below with reference to FIG. 8 (step S14).

Next, the ECU 14 calculates the energization period TI by adding together the injection invalid period TA calculated in step S14 and the effective injection period TB set in accordance with the required injection amount for the current fuel injection (step S15). The ECU 14 then determines whether or not a predetermined period has elapsed following engine startup (step S16). Here, engine startup occurs when an operation is performed to start the engine. An ON operation of an ignition switch or the like, for example, serves as the operation to start the engine. When a large amount of time has not yet elapsed following engine startup, an engine temperature remains in the vicinity of an outside air temperature, and therefore the engine temperature is likely to be included in a fixed temperature range from which the outside air temperature can be obtained. Hence, in the control apparatus 10 for a fuel injection valve according to this embodiment, the predetermined period is set in advance so that it can be estimated whether or not the engine temperature is within the fixed temperature range on the basis of the elapsed time following engine startup.

When the predetermined period following engine startup has elapsed (step S16: YES), or in other words when it can be estimated that the engine temperature is not within the temperature range, the ECU 14 terminates the processing routine of the current fuel injection without calculating the variation ratio learned value Rc. When, on the other hand, the predetermined period following engine startup has not elapsed (step S16: NO), or in other words when it can be estimated that the engine temperature is within the temperature range, the ECU 14 advances the processing to a following step S17.

A resistance value of the solenoid 21 of the fuel injection valve 20 varies according to a temperature of the solenoid. In other words, when the temperature of the solenoid 21 differs during calculation of the variation ratio learned value Rc, even assuming all other conditions during calculation of the variation ratio learned value Rc match, the respective detection periods T1r, T2r, T3r vary. As a result, variation in the calculated variation ratio learned value Rc is likely to increase. When it can be estimated that the engine temperature is within the temperature range, on the other hand, variation in the temperature of the solenoid 21 decreases, leading to a reduction in variation in the resistance value of the solenoid 21 corresponding to the temperature of the solenoid 21. In other words, the calculated variation ratio learned value Rc is less likely to vary. Hence, in the control apparatus 10 for a fuel injection valve according to this embodiment, calculation of the variation ratio learned value Rc is permitted only when it can be estimated that the engine temperature is within the temperature range.

In step S17, the ECU 14 determines whether or not the peak current value Ip set in relation to the current fuel injection is the peak set value Ipa. When the peak current value Ip is not the peak set value Ipa (step S17: NO), the ECU 14 terminates the processing routine of the current fuel injection without calculating the variation ratio learned value Rc.

When the peak current value Ip is the peak set value Ipa (step S17: YES), on the other hand, the ECU 14 determines whether or not the energization period TI calculated in step S15 exceeds a peak arrival period TI_Th serving as a predetermined period (step S18). The peak arrival period TI_Th is an estimated value of a period from the energization start point to the peak arrival point at which the excitation current Iinj reaches the peak set value Ipa. When the energization period TI is equal to or shorter than the peak arrival period TI_Th, it is possible that during the current fuel injection, energization of the fuel injection valve 20 will be terminated before the excitation current Iinj reaches the peak current value Ip, or in other words during the opening period TO.

When the energization period TI is equal to or shorter than the peak arrival period TI_Th (step S18: NO), the ECU 14 terminates the processing routine of the current fuel injection without calculating the variation ratio learned value Rc. When the energization period TI exceeds the peak arrival period TI_Th (step S18: YES), on the other hand, the ECU 14 performs processing to calculate the variation ratio learned value Rc (step S19), to be described below with reference to FIG. 7, and then terminates the current processing routine.

Figure 6:
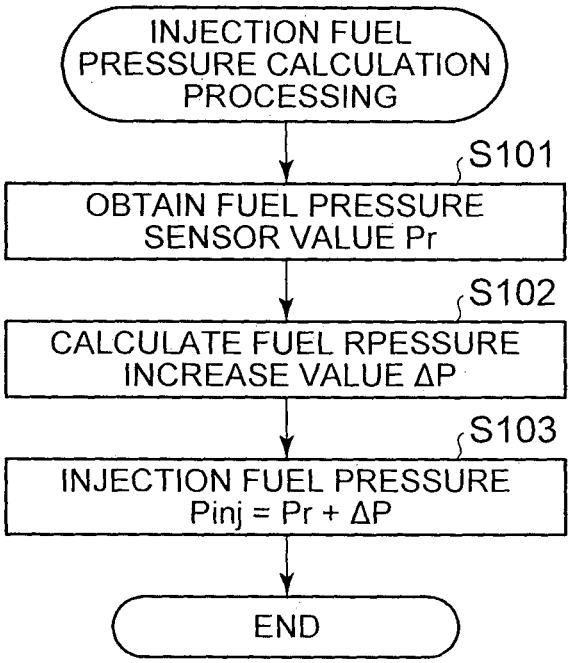
FIG. 6 is a flowchart illustrating a processing routine executed by the control apparatus to calculate an injection fuel pressure.

Next, referring to a flowchart shown in FIG. 6, a processing routine for calculating the injection fuel pressure in step S11 will be described. In this processing routine, as shown in FIG. 6, the ECU 14 obtains a fuel pressure sensor value Pr, which is a detected value of the fuel pressure in the delivery pipe 54 detected by the fuel pressure sensor 43 (step S101). The fuel pressure sensor value Pr is a value detected at intervals of a preset detection cycle, and in step S101, the newest fuel pressure sensor value Pr detected by the fuel pressure sensor 43 is obtained. Next, the ECU 14 calculates a fuel pressure increase value ΔP, which is an amount by which the fuel pressure in the delivery pipe 54 increases from the point at which the newest fuel pressure sensor value Pr was detected to the current energization start point (step S102).

When fuel is supplied to the delivery pipe 54 from the high pressure fuel pump 53, the fuel pressure in the delivery pipe 54 increases. Therefore, when no fuel is supplied to the delivery pipe 54 from the high pressure fuel pump 53 from the detection point of the newest fuel pressure sensor value Pr to the current energization start point, the fuel pressure increase value ΔP is "0 (zero)". When fuel is supplied to the delivery pipe 54 from the high pressure fuel pump 53 from the detection point of the newest fuel pressure sensor value Pr to the current energization start point, on the other hand, an amount of fuel supplied by the high pressure fuel pump 53 over a period from a start point of the fuel supply to the delivery pipe 54 from the high pressure fuel pump 53 to the energization start point is obtained. The fuel pressure increase value ΔP is then calculated as shown in a following relational expression (Equation 1). Here, the amount of fuel supplied by the high pressure fuel pump 53 over the period from the start point of the fuel supply to the delivery pipe 54 from the high pressure fuel pump 53 to the current energization start point is set as "F1", an internal capacity of the delivery pipe 54 is set as "F2", and a bulk modulus of the fuel is set as "F3".

$$\Delta P = F1 \times \frac{F3}{F2} \quad \text{(Equation 1)}$$

Next, the ECU 14 adds the fuel pressure increase value ΔP calculated in step S102 to the newest fuel pressure sensor value Pr obtained in step S101, and sets a resulting sum (=Pr+ΔP) as the injection fuel pressure Pinj (step S103). The ECU 14 then terminates the current processing routine.

Figure 9:
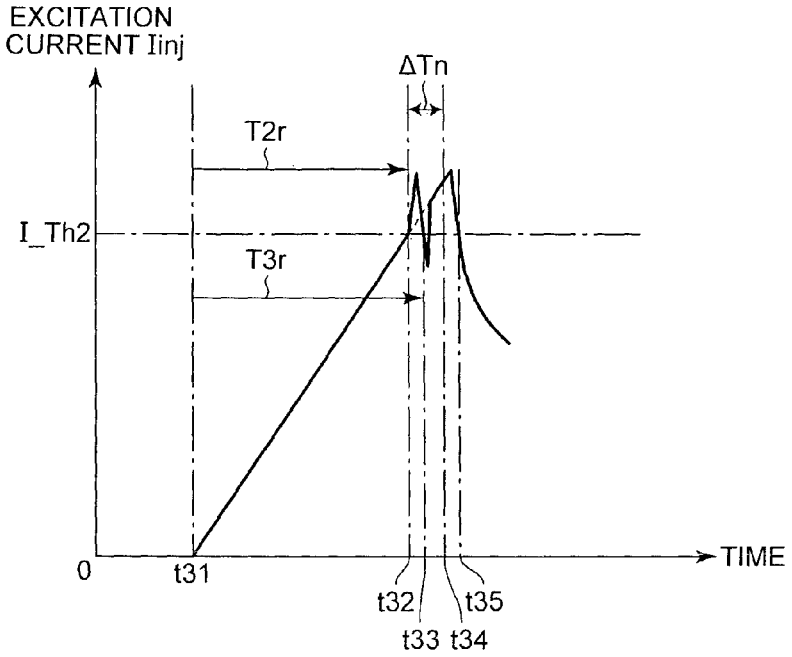
FIG. 9 is a timing chart showing a manner in which noise is superimposed on the excitation current that flows in the solenoid when fuel is injected from the fuel injection valve.
Figure 10:
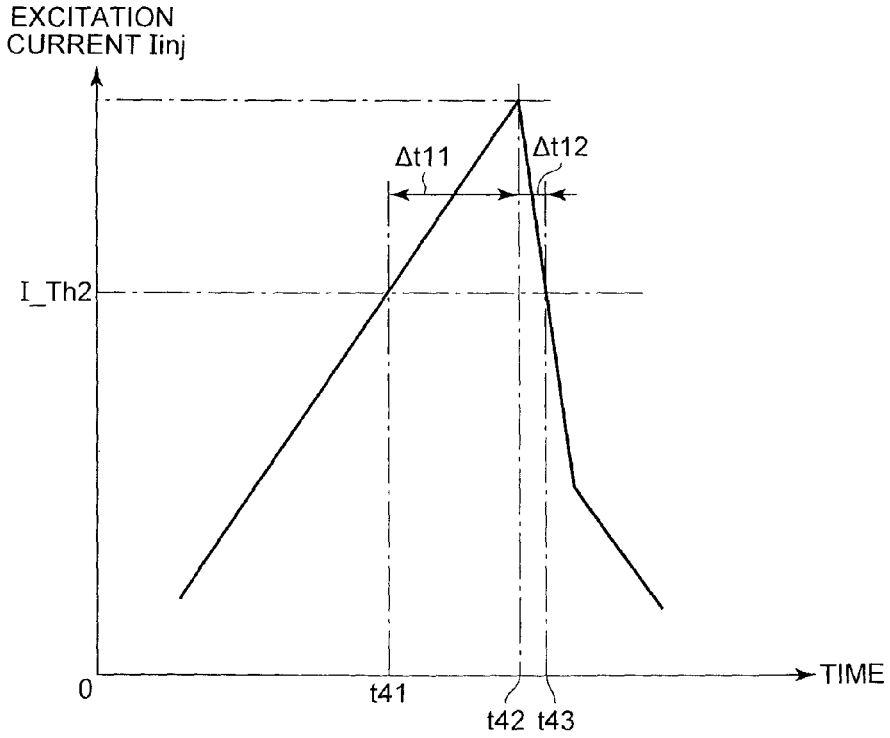
FIG. 10 is a timing chart showing variation in the excitation current that flows in the solenoid when fuel is injected from the fuel injection valve.

Next, referring to a flowchart shown in FIG. 7, timing charts shown in FIGS. 9 to 11, and maps shown in FIGS. 12 and 13, a processing routine for calculating the variation ratio learned value Rc in step S19 will be described.

Figure 7:
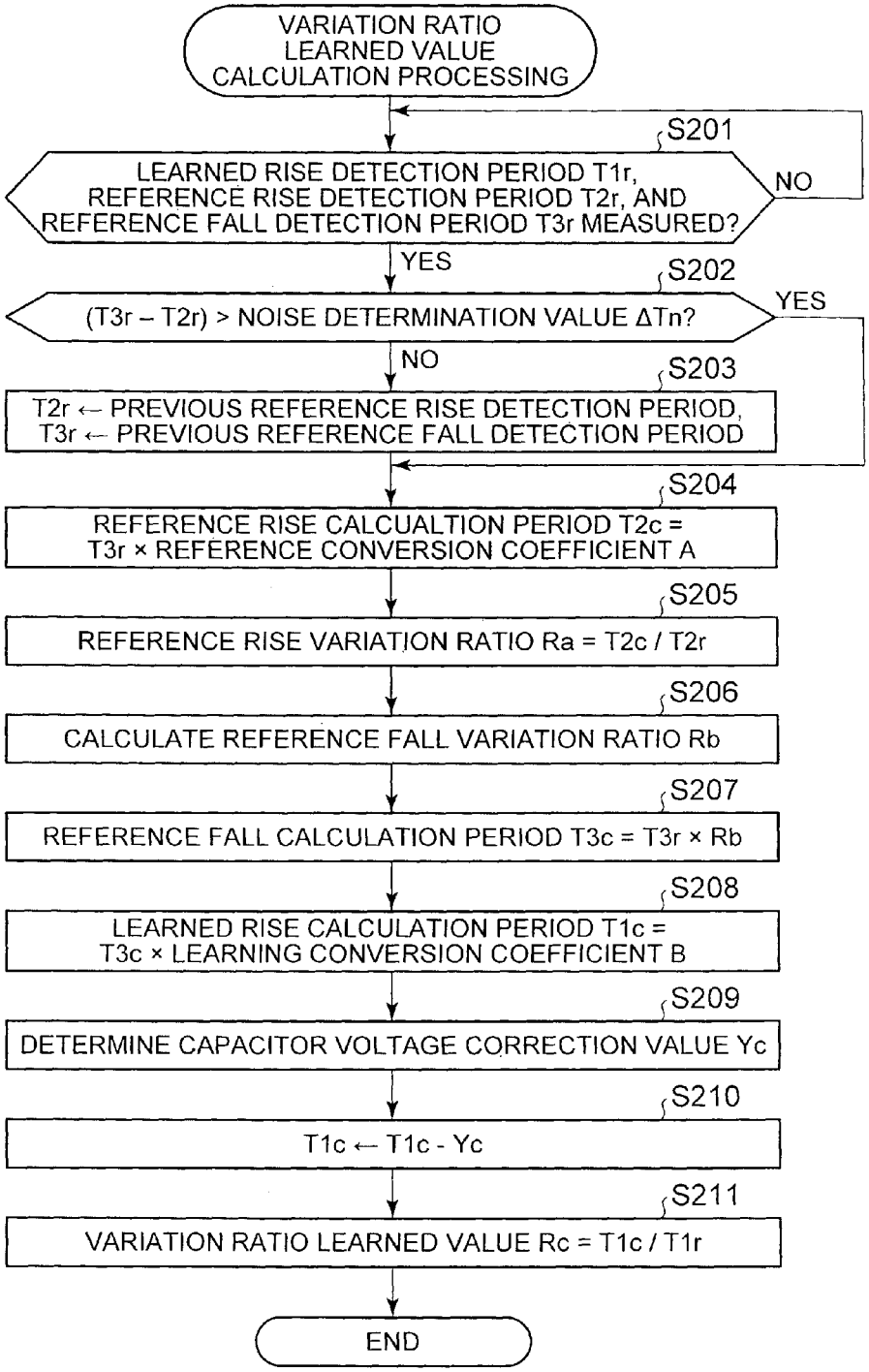
FIG. 7 is a flowchart illustrating a processing routine executed by the control apparatus to calculate a variation ratio learned value.

In this processing routine, as shown in FIG. 7, the ECU 14 determines whether or not the learned rise detection period T1r, the reference rise detection period T2r, and the reference fall detection period T3r have been measured in relation to the current fuel injection (step S201). When measurement of at least one of the detection periods T1r, T2r, T3r is not yet complete (step S201: NO), or in other words when the reference fall detection point has not yet been reached, the ECU 14 executes the determination processing of step S201 repeatedly until measurement of all of the detection periods T1r, T2r, T3r is complete.

When measurement of all of the detection periods T1r, T2r, T3r is complete (step S201: YES), on the other hand, the ECU 14 calculates a difference by subtracting the reference rise detection period T2r from the reference fall detection period T3r, and determines whether or not the calculated difference (=T3r−T2r) is greater than a predetermined noise determination value ΔTn (step S202).

Here, noise may be superimposed onto the excitation current Iinj detected by the current detection circuit 42. FIG. 9 shows an example in which noise is superimposed onto the excitation current Iinj immediately after measurement of the reference rise detection period T2r is completed at a second timing t32 serving as the reference rise detection point. In this example, the excitation current Iinj falls below the reference current value I_Th2 at a third timing t33 prior to a fifth timing t35 serving as the original reference fall detection point, and therefore the third timing t33 may be detected erroneously as the reference fall detection point. In this case, a period from a first timing t31 serving as the energization start point to the second timing t32 is set erroneously as the reference fall detection period T3r.

In the control apparatus 10 for a fuel injection valve according to this embodiment, the noise determination value ΔTn is set in advance to respond to cases where noise is superimposed onto the excitation current Iinj, as described above. When the excitation current Iinj falls below the reference current value I_Th2 before a fourth timing t34, at which an amount of time corresponding to the noise determination value ΔTn has elapsed following the second timing t32 serving as the reference rise detection point, it is determined that the reference fall detection point has been detected erroneously due to noise superimposed on the excitation current Iinj.

Returning to FIG. 7, when the difference (=T3r−T2r) is greater than the noise determination value ΔTn (step S202: YES), or in other words when the reference fall detection point has been detected correctly, the ECU 14 advances the processing to step S204, to be described below. When the difference (=T3r−T2r) is equal to or smaller than the noise determination value ΔTn (step S202: NO), on the other hand, or in other words when the reference fall detection point has been detected erroneously, the ECU 14 advances the processing to a following step S203. In step S203, the ECU 14 obtains the reference rise detection period used to calculate the previous variation ratio learned value Rc, and sets the obtained value as the reference rise detection period T2r to be used to calculate the current variation ratio learned value Rc. Further, the ECU 14 obtains the reference fall detection period used to calculate the previous variation ratio learned value Rc, and sets the obtained value as the reference fall detection period T3r to be used to calculate the current variation ratio learned value Rc. The ECU 14 then advances the processing to the following step S204.

In S204, the ECU 14 calculates a product by multiplying a reference conversion coefficient A by the reference fall detection period T3r, and sets the calculated product (=T3r×A) as the reference rise calculation period T2c. As shown in FIG. 10, the excitation current decrease speed at which the excitation current Iinj decreases from the peak current value Ip is much higher than the excitation current increase speed at which the excitation current Iinj increases to the peak current value Ip. Therefore, even when the excitation current Iinj is monitored using the same current detection circuit 42, a reference fall detection point t43 is less likely to vary than a reference rise detection point t41.

Further, in a condition where the peak current value Ip is fixed at the peak set value Ipa, the excitation current increase speed at which the excitation current Iinj increases toward the peak current value Ip and the excitation current decrease speed at which the excitation current Iinj decreases from the peak current value Ip have a constant correlative relationship. In other words, a period Δt11 from the reference rise detection point t41 to a peak arrival point t42 increases steadily in length as a period Δt12 from the peak arrival point t42 to the reference fall detection point t43 is longer. Accordingly, the reference conversion coefficient A is prepared in advance to correspond to this correlative relationship. The reference rise calculation period T2c, which is a calculated value of a period from the energization start point to the reference rise detection point t41, is then calculated by multiplying the reference conversion coefficient A by the measured reference fall detection period T3r.

Returning to FIG. 7, the ECU 14, having calculated the reference rise calculation period T2c in step S204, calculates a quotient by dividing the reference rise calculation period T2c by the reference rise detection period T2r, and sets the calculated quotient (=T2c/T2r) as a reference rise variation ratio Ra (step S205). The reference rise variation ratio Ra is a value corresponding to a current value detection error generated by the current detection circuit 42 at the reference rise detection point. On the basis of the reference rise variation ratio Ra calculated in step S205, the ECU 14 calculates a reference fall variation ratio Rb corresponding to a current value detection error generated by the current detection circuit 42 at the reference fall detection point (step S206).

Figure 11:
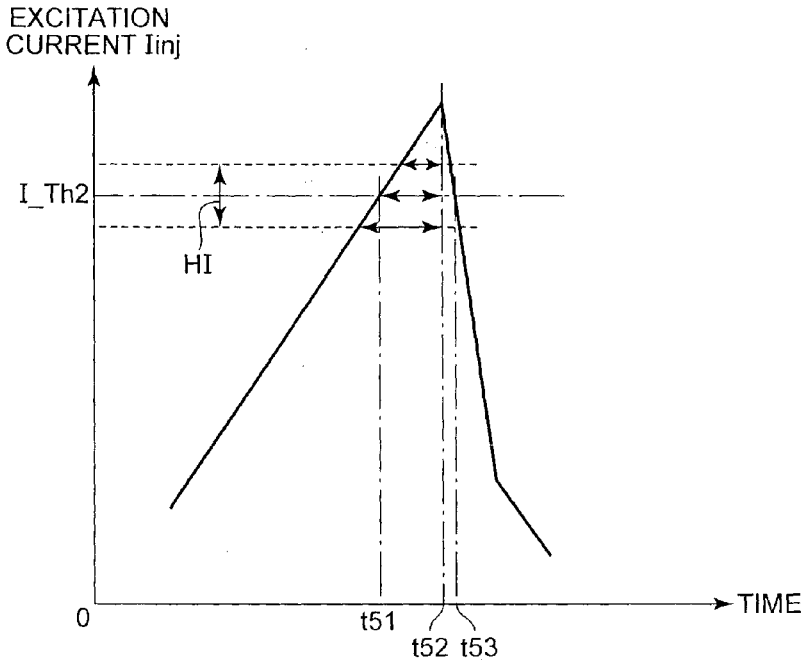
FIG. 11 is a timing chart showing variation in the excitation current that flows in the solenoid when fuel is injected from the fuel injection valve.

As shown in FIG. 11, the excitation current Iinj detected by the current detection circuit 42 includes a detection error. Therefore, even when a reference rise detection point t51 is detected, the actual current value may vary within a current detection range HI determined from the detection error of the current detection circuit 42 and so on. A similar divergence between the actual current value and the current value detected by the current detection circuit 42 occurs, when a reference fall detection point t53 following a peak arrival point t52 is detected. In other words, the actual current value may vary within the current detection range HI likewise when the reference fall detection point t53 is detected. Hence, the reference rise variation ratio Ra and the reference fall variation ratio Rb have a constant correlative relationship according to which the reference fall variation ratio Rb increases steadily as the reference rise variation ratio Ra increases.

Figure 12:
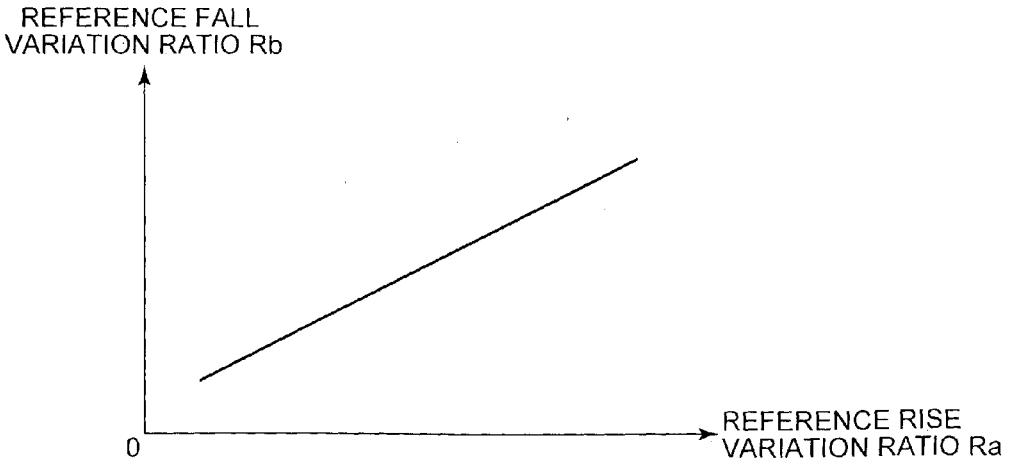
FIG. 12 is a map showing a relationship between a reference rise variation ratio and a reference fall variation ratio.

In the control apparatus 10 for a fuel injection valve according to this embodiment, the map shown in FIG. 12 is prepared in advance and used to calculate the reference fall variation ratio Rb. The map of FIG. 12 shows the relationship between the reference rise variation ratio Ra and the reference fall variation ratio Rb. As shown in FIG. 12, the reference fall variation ratio Rb increases steadily as the reference rise variation ratio Ra increases.

Returning to FIG. 7, the ECU 14, having calculated the reference fall variation ratio Rb in step S206, calculates a product by multiplying the reference fall variation ratio Rb by the reference fall detection period T3r, and sets the calculated product (=T3r×Rb) as the reference fall calculation period T3c (step S207). The reference fall calculation period T3c is a value that not easily affected by variation in the current value detected by the current detection circuit 42, and therefore a precision thereof is higher than a precision of the reference fall detection period T3r. Next, the ECU 14 calculates a product by multiplying a learning conversion coefficient B by the calculated reference rise calculation period T3c, and sets the calculated product (=T3c×B) as the learned rise calculation period T1c (step S208).

As described above, in a condition where the peak current value Ip is fixed at the peak set value Ipa, the excitation current increase speed at which the excitation current Iinj increases to the peak current value Ip and the excitation current decrease speed at which the excitation current Iinj decreases from the peak current value Ip have a constant correlative relationship. In other words, the period from the learned rise detection point to the peak arrival point increases steadily in length as the period from the peak arrival point to the reference fall detection point is longer. Accordingly, the learning conversion coefficient B is prepared in advance to correspond to this correlative relationship, whereupon the learned rise calculation period T1c, which is a calculated value of a period from the energization start point to the learned rise detection point, is calculated by multiplying the learning conversion coefficient B by the calculated reference fall calculation period T3c.

The ECU 14 then determines a capacitor voltage correction value Yc based on the capacitor voltage Vc detected in step S12 (step S209). When the capacitor voltage Vc is low, the voltage applied to the solenoid 21 of the fuel injection valve 20 during the opening period TO is low, and therefore the increase speed of the excitation current Iinj flowing in the solenoid 21 is more likely to decrease. Hence, when the capacitor voltage Vc is low during a fuel injection in which the variation ratio learned value Rc is calculated, the learned rise calculation period T1c may be corrected so that an effect of a reduction in the capacitor voltage Vc at the current energization start point can be minimized. In the control apparatus 10 for a fuel injection valve according to this embodiment, therefore, the capacitor voltage correction value Yc is set at a value corresponding to the capacitor voltage Vc at the current energization start point using the map shown in FIG. 13.

Figure 13:
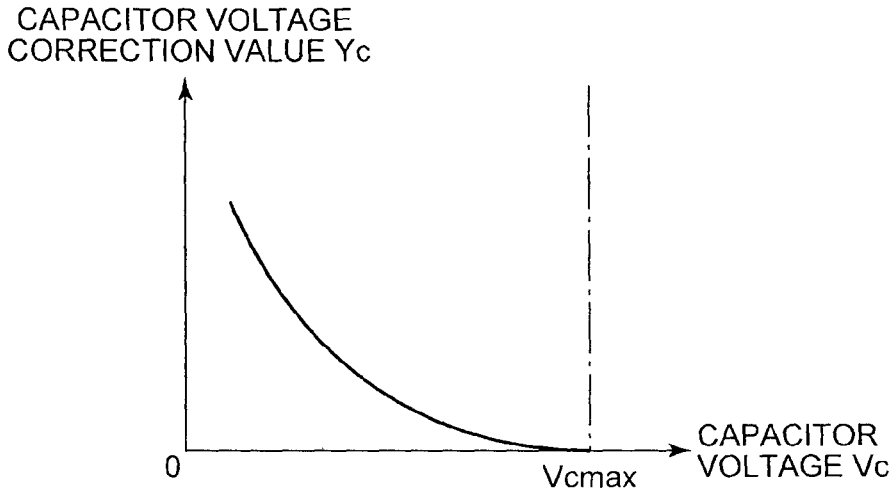
FIG. 13 is a map showing a relationship between a capacitor voltage and a capacitor voltage correction value.

The map of FIG. 13 shows a relationship between the capacitor voltage Vc at the energization start point and the capacitor voltage correction value Yc. As shown in FIG. 13, the capacitor voltage correction value Yc decreases steadily as the capacitor voltage Vc at the energization start point increases. When the capacitor voltage Vc at the energization start point equals or exceeds a maximum voltage value Vcmax, the capacitor voltage correction value Yc is "0 (zero)". Note that the maximum voltage value Vcmax is a maximum value of the capacitor voltage that can be envisaged from a design value of the capacity of the capacitor 12.

Returning to FIG. 7, the ECU 14, having determined the capacitor voltage correction value Yc in step S209, calculates a difference by subtracting the capacitor voltage correction value Yc from the learned rise calculation period T1c calculated in step S208, and sets the calculated difference (=T1c−Yc) as the learned rise calculation period T1c (step S210). In step S210, the learned rise calculation period T1c decreases steadily as the capacitor voltage Vc at the current energization start point decreases. Next, the ECU 14 calculates a quotient by dividing the learned rise calculation period T1c corrected in step S210 by the learned rise detection period T1r, and sets the calculated quotient (=T1c/T1r) as the variation ratio learned value Rc (step S211). The ECU 14 then terminates the current processing routine.

Figure 14:
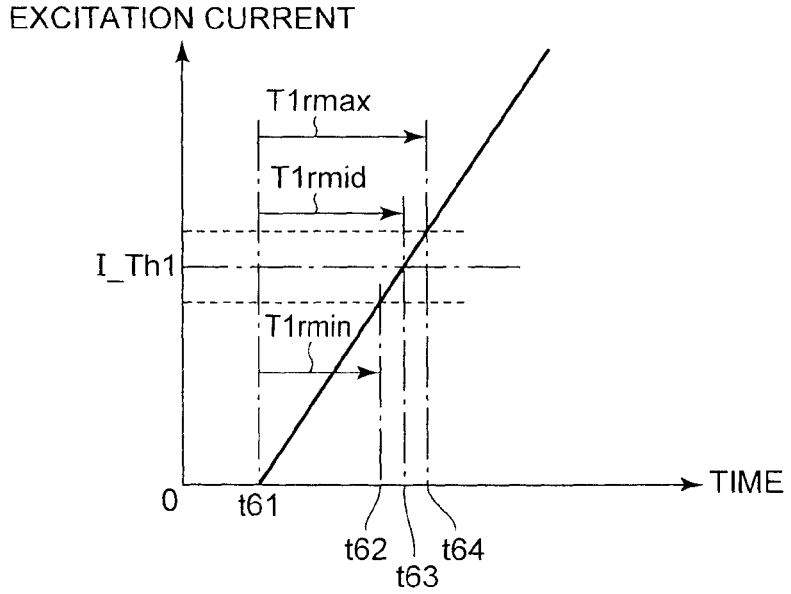
FIG. 14 is a timing chart showing transitions of the excitation current that flows in the solenoid when fuel is injected from the fuel injection valve.

Next, referring to a flowchart shown in FIG. 8, a timing chart shown in FIG. 14, and maps shown in FIGS. 15 and 16, a processing routine for calculating the injection invalid period TA in step S14 will be described.

Figure 8:
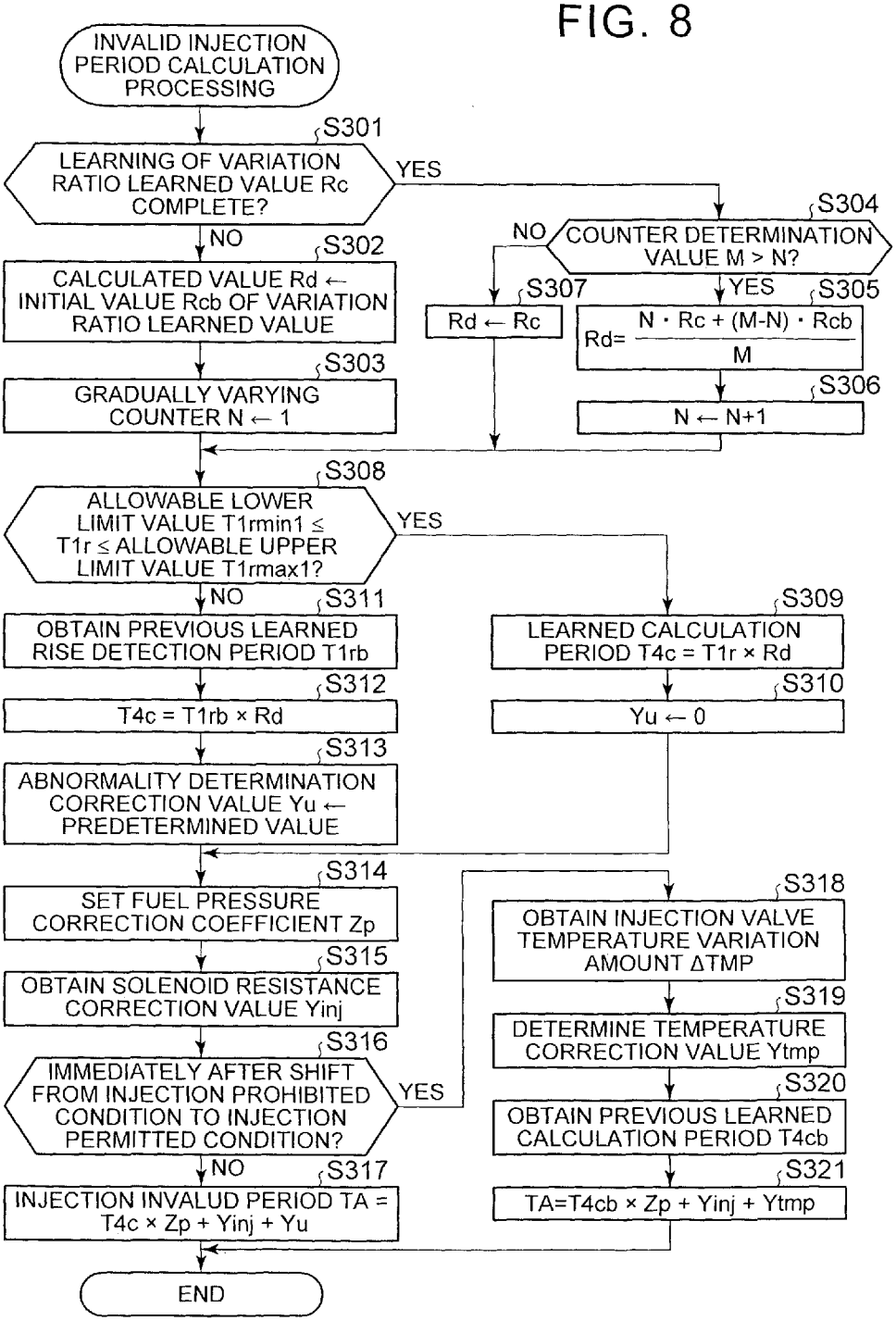
FIG. 8 is a flowchart illustrating a processing routine executed by the control apparatus to calculate an injection invalid period.

In this processing routine, as shown in FIG. 8, the ECU 14 determines whether or not learning of the variation ratio learned value Rc is complete (step S301). When learning of the variation ratio learned value Rc is not yet complete (step S301: NO), the ECU 14 sets a preset initial value Rcb of the variation ratio learned value as a calculated value Rd (step S302). Next, the ECU 14 sets a gradually varying counter N at "1" (step S303), and then advances the processing to step S308, to be described below.

Here, the initial value Rcb of the variation ratio learned value will be described. As shown in FIG. 14, the learned rise detection point, which is the point at which the excitation current Iinj detected by the current detection circuit 42 increases beyond the learning current value I_Th1, may vary between a second timing t62 and a fourth timing t64 due to variation in the current value detected by the current detection circuit 42. In other words, when the excitation current Iinj is detected by the current detection circuit 42 to be larger than an actual excitation current, the learned rise detection point is detected at an earlier timing than the third timing t63 at which the actual excitation current exceeds the learning current value I_Th1. Further, when the excitation current Iinj is detected by the current detection circuit 42 to be smaller than the actual excitation current, the learned rise detection point is detected at a later timing than the third timing t63.

Incidentally, the second timing t62 is the earliest timing at which the learned rise detection point can be detected. A minimum value T1rmin of the learned rise detection period, which is a period from a first timing t61 serving as the energization start point to the second timing t62, may be set in advance by experiment, simulation, and so on. Further, the fourth timing t64 is the latest timing at which the learned rise detection point can be detected. Similarly to the minimum value T1rmin, a maximum value T1rmax of the learned rise detection period, which is a period from the first timing t61 to the fourth timing t64, may be set in advance by experiment, simulation, and so on. Furthermore, a central characteristic value T1rmid of the learned rise detection period, which is a period from the first timing t61 to the third timing t63, may be set in advance by experiment, simulation, and so on.

As described above, the learned rise detection period T1r may vary between the minimum value T1rmin and the maximum value T1rmax. In contrast, the learned rise calculation period T1c, which is more precise than the learned rise detection period T1r, varies within a narrower range than the learned rise detection period T1r. In other words, the learned rise calculation period T1c varies in the vicinity of the central characteristic value T1rmid of the learned rise detection period.

Taking the above into consideration, the initial value Rcb of the variation ratio learned value is calculated using a following relational expression (Equation 2). The calculated initial value Rcb of the variation ratio learned value is then stored in the memory of the ECU 14 in advance.

$$Rcb = \frac{T1rmid}{T1rmin} \quad \text{(Equation 2)}$$

By setting a quotient obtained by dividing the central characteristic value T1rmid by the minimum value T1rmin, which is the value furthest removed from the central characteristic value T1rmid, as the initial value Rcb in this manner, the initial value Rcb takes an extremely large value within a calculable range of the variation ratio learned value Rc. In other words, in the control apparatus 10 for a fuel injection valve according to this embodiment, the variation ratio learned value Rc is not larger than the initial value Rcb of the variation ratio learned value calculated as described above.

Returning to FIG. 8, when learning of the variation ratio learned value Rc is complete (step S301: YES), the ECU 14 determines whether or not the gradually varying counter N is lower than a preset count determination value M (step S304). When the gradually varying counter N is lower than the count determination value M (step S304: YES), the ECU 14 calculates the calculated value Rd using a following relational expression (Equation 3) (step S305).

$$Rd = \frac{N \cdot Rc + (M - N) \cdot Rcb}{M} \quad \text{(Equation 3)}$$

The ECU 14 then increments the gradually varying counter N by "1" (step S306), and then advances the processing to a following step S308. In other words, after calculation of the variation ratio learned value Rc is complete, the calculated value Rd gradually approaches the variation ratio learned value Rc from the initial value Rcb of the variation ratio learned value every time fuel is injected from the fuel injection valve 20.

When the gradually varying counter N equals or exceeds the count determination value M (step S304: NO), on the other hand, the ECU 14 sets the learned variation ratio learned value Rc as the calculated value Rd (step S307), and then advances the process to the following step S308.

In step S308, the ECU 14 determines whether or not the learned rise detection period T1r measured during the current fuel injection is no smaller than a predetermined allowable lower limit value T1rmin1 and no larger than a predetermined allowable upper limit value T1rmax1. The allowable lower limit value T1rmin1 is set at a shorter period than a minimum value of the learned rise detection period that can be envisaged from the characteristics of the current detection circuit 42, the peak current value Ip set in relation to the current fuel injection, and so on. Similarly, the allowable upper limit value T1rmax1 is set at a longer period than a maximum value of the learned rise detection period that can be envisaged from the characteristics of the current detection circuit 42, the peak current value Ip set in relation to the current fuel injection, and so on. Hence, when the learned rise detection period T1r is smaller than the allowable lower limit value T1rmin1 or exceeds the allowable upper limit value T1rmax1, or in other words when the learned rise detection period T1r is not included in a predetermined allowable range, it may be determined that an abnormal condition in which the learned rise detection period T1r cannot be measured accurately is established.

When the learned rise detection period T1r is no smaller than the allowable lower limit value T1rmin1 and no larger than the allowable upper limit value T1rmax1 (step S308: YES), or in other words when the learned rise detection period T1r is included in the allowable range, the ECU 14 advances the processing to a following step S309. In step S309, the ECU 14 calculates a product by multiplying the calculated value Rd by the learned rise detection period T1r measured during the current fuel injection, and sets the calculated product (=T1r×Rd) as the learned calculation period T4c. The learned calculation period T4c corresponds to a calculated value of the period from the energization start point of the current fuel injection to the learned rise detection point. Next, the ECU 14 sets an abnormality determination correction value Yu at "0 (zero)" (step S310), and then advances the processing to a following step S314.

When the learned rise detection period T1r is smaller than the allowable lower limit value T1rmin1 or larger than the allowable upper limit value T1rmax1 (step S308: NO), on the other hand, the ECU 14 obtains the learned rise detection period calculated during the previous fuel injection, and sets the obtained value as a previous learned rise detection period T1rb (step S311). The ECU 14 then calculates a product by multiplying the calculated value Rd by the obtained previous learned rise detection period T1rb, and sets the calculated product (=T1rb×Rd) as the learned calculation period T4c (step S312). Next, the ECU 14 sets a preset predetermined value (>0 (zero)) as the abnormality determination correction value Yu (step S313). This predetermined value is set such that the calculated injection invalid period TA is longer than an actual injection invalid period. The ECU 14 then advances the processing to the following step S314.

Figure 15:
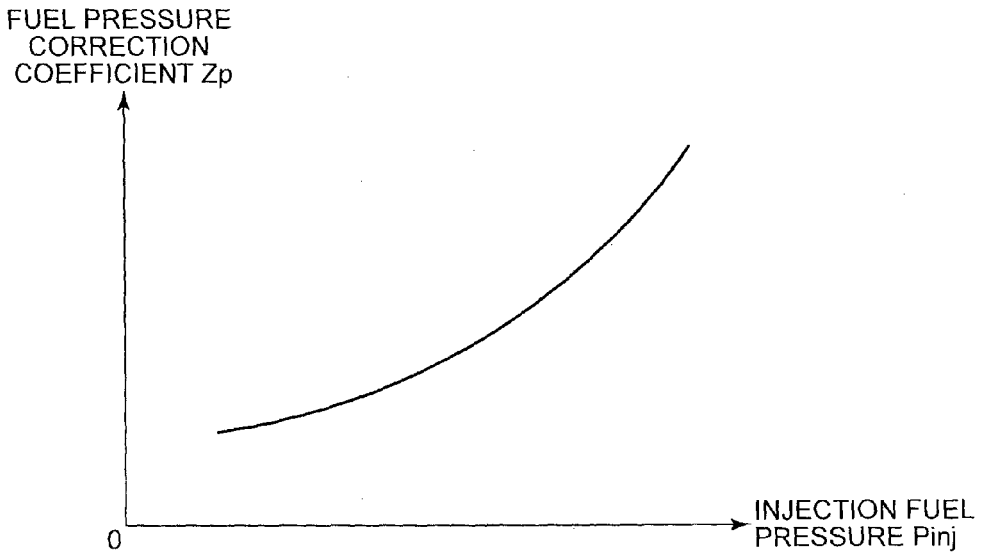
FIG. 15 is a map showing a relationship between the injection fuel pressure and a fuel pressure correction coefficient.

In step S314, the ECU 14 sets a fuel pressure correction coefficient Zp at a value corresponding to the injection fuel pressure Pinj calculated in step S103 using a map shown in FIG. 15. The map of FIG. 15 shows a relationship between the fuel pressure correction coefficient Zp and the injection fuel pressure Pinj. As shown in FIG. 15, the fuel pressure correction coefficient Zp takes a steadily larger value as the injection fuel pressure Pinj increases.

Returning to FIG. 8, the ECU 14, having determined the fuel pressure correction coefficient Zp in step S314, obtains a solenoid resistance correction value Yinj corresponding to the resistance value of the solenoid 21 of the fuel injection valve 20 performing the current fuel injection (step S315). The resistance value of the solenoid 21 of the fuel injection valve 20 may differ among individual solenoids 21 due to manufacturing errors. The solenoid resistance correction value Yinj, which is a correction component corresponding to individual differences in the resistance value of the solenoid 21, is set in advance on the basis of tests results and the like obtained at the time of shipping, for example.

The ECU 14 then determines whether or not an operating condition of the internal combustion engine (the engine) has recently shifted from an injection prohibited condition, in which direct fuel injection into the combustion chamber by the fuel injection valves 20 is prohibited, to an injection permitted condition, in which direct fuel injection into the combustion chamber by the fuel injection valves 20 is performed (step S316).

When the injection permitted condition remains continuously established, fuel is injected from the fuel injection valve 20, and therefore the temperature of the fuel injection valve 20 exhibits substantially no variation between a previous fuel injection point and a current fuel injection point of the fuel injection valve 20. The injection prohibited condition, on the other hand, is an operating condition in which the engine operation is intermittently stopped, such as an idling stop. Further, in an internal combustion engine (an engine) that includes a port injection fuel injection valve that injects fuel into an intake passage in addition to the fuel injection valves 20 that inject fuel directly into the combustion chamber, the injection prohibited condition is also established during an engine operation in which fuel is injected only into the intake passage. Furthermore, in a vehicle having an additional power supply such as a motor in addition to the internal combustion engine (the engine), the injection prohibited condition is likewise established when the internal combustion engine (the engine) is intermittently stopped in a travel mode using the other power supply.

When the injection prohibited condition remains continuously established, fuel is not injected from the fuel injection valve 20, and therefore a cooling action accompanying fuel injection by the fuel injection valve 20 does not occur. As a result, the temperature of the fuel injection valve 20 may increase. In this case, the temperature of the solenoid 21 also increases, leading to an increase in the resistance value of the solenoid 21. When the injection permitted condition is established following an increase in the temperature of the fuel injection valve 20 such that fuel is injected from the fuel injection valve 20, it may be difficult for the valve to open due to the increased resistance value of the solenoid 21.

In other words, when the condition of the internal combustion engine (the engine) shifts from the injection prohibited condition to the injection permitted condition such that fuel injection from the fuel injection valve 20 is resumed, an opening characteristic of the fuel injection valve 20 may diverge from an opening characteristic of the fuel injection valve 20 before the condition of the internal combustion engine (the engine) entered the injection permitted condition. Hence, the method of calculating the injection invalid period TA may be modified depending on whether or not the internal combustion engine (the engine) is in an operating condition immediately after shifting from the injection prohibited condition to the injection permitted condition.

When the injection permitted condition remains continuously established (step S316: NO), the ECU 14 calculates the injection invalid period TA using a following relational expression (Equation 4) (step S317), and then terminates the current processing routine.

$$TA=T4c\times Zp+Yinj+Yu \quad \text{(Equation 4)}$$

Immediately after a shift from the injection prohibited condition to the injection permitted condition (step S316: YES), on the other hand, the ECU 14 obtains an injection valve temperature variation amount ΔTMP, which is an amount of variation in the temperature of the fuel injection valve 20 over the period in which the internal combustion engine (the engine) was in the injection prohibited condition (step S318). For example, the injection valve temperature variation amount ΔTMP may be calculated by subtracting the temperature of the fuel injection valve 20 at the previous fuel injection point of the fuel injection valve 20 from the current temperature of the fuel injection valve 20. The ECU 14 then sets a temperature correction value Ytmp at a value corresponding to the injection valve temperature variation amount ΔTMP using a map shown in FIG. 16 (step S319).

Figure 16:
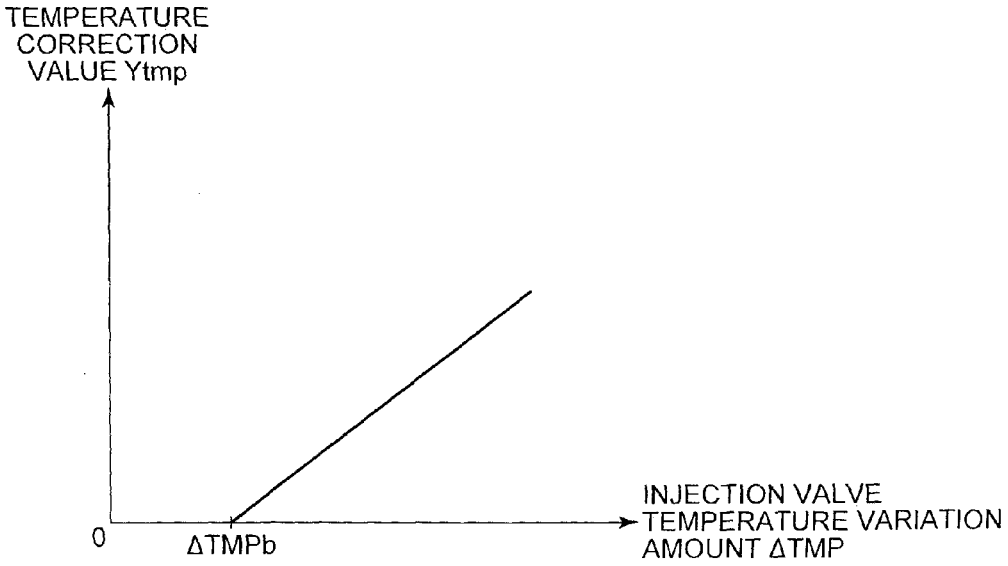
FIG. 16 is a map showing a relationship between an injection valve temperature variation amount and a temperature correction value.

The map of FIG. 16 shows a relationship between the temperature correction value Ytmp and the injection valve temperature variation amount ΔTMP. As shown in FIG. 16, when the injection valve temperature variation amount ΔTMP is equal to or smaller than a reference variation amount ΔTMPb, the temperature correction value Ytmp is set at "0 (zero)". The reason for this is that when the injection valve temperature variation amount ΔTMP is equal to or smaller than the reference variation amount ΔTMPb, it may be estimated that the variation in the resistance value of the solenoid 21 caused by variation in the temperature of the fuel injection valve 20 is negligible. When the injection valve temperature variation amount ΔTMP exceeds the reference variation amount ΔTMPb, on the other hand, the temperature correction value Ytmp is set at a steadily larger value as the injection valve temperature variation amount ΔTMP increases.

Returning to FIG. 8, the ECU 14, having determined the temperature correction value Ytmp in step S319, obtains the last learned calculation period to be calculated before the internal combustion engine (the engine) entered the injection prohibited condition, and sets the obtained value as a previous learned calculation period T4cb (step S320). The ECU 14 then calculates the injection invalid period TA using a following relational expression (Equation 5) (step S321), and then terminates the current processing routine.

$$TA=T4cb\times Zp+Yinj+Ytmp \quad \text{(Equation 5)}$$

Next, an operation performed when fuel is injected by the fuel injection valve 20 will be described. Note that it is assumed here that the variation ratio learned value Rc was not calculated before the start of the current engine operation.

When an operation to switch an ignition switch ON or the like is performed to start the engine, an engine operation begins. When the condition of the internal combustion engine (the engine) shifts to the injection permitted condition in which fuel can be injected directly into the combustion chamber from the fuel injection valve 20, fuel is injected from the fuel injection valve 20. When the peak current value Ip set during energization of the fuel injection valve 20 is the peak set value Ipa, the variation ratio learned value Rc is calculated during the current fuel injection (step S14).

Note that during a fuel injection performed while the variation ratio learned value Rc is being calculated, calculation of the variation ratio learned value Rc is not yet complete (step S301: NO). Therefore, when the excitation current Iinj reaches the learned rise detection point exceeding the learning current value I_Th1, the learned calculation period T4c is calculated by multiplying the preset initial value Rcb of the variation ratio learned value by the learned rise detection period T1r serving as the measured value of the period from the energization start point to the learned rise detection point (steps S302, S308). The injection invalid period TA of the current fuel injection increases in length as the learned calculation period T4c is longer (step S315). At this time, the injection invalid period TA is also adjusted in accordance with the injection fuel pressure Pinj (steps S312, S315). By calculating the energization period TI using the injection invalid period TA, the actual fuel injection amount can be prevented from falling below the required injection amount.

During the fuel injection performed by the fuel injection valve 20, the reference rise detection period T2r and the reference fall detection period T3r are measured in addition to the learned rise detection period T1r. Further, the reference rise calculation period T2c, the reference fall calculation period T3c, and the learned rise calculation period T1c are calculated as well as measuring the detection periods T1r to T3r (steps S204 to S208). When the learned rise calculation period T1c is corrected on the basis of the capacitor voltage Vc at the energization start point (step S220), the variation ratio learned value Rc is calculated by dividing the corrected learned rise calculation period T1c by the learned rise detection period T1r.

Once the variation ratio learned value Rc has been calculated in this manner, the calculated value Rd approaches the variation ratio learned value Rc from the initial value Rcb of the variation ratio learned value gradually every time fuel is injected by the fuel injection valve 20 thereafter (steps S304 to S306). Accordingly, the effect of the variation in the current value detected by the current detection circuit 42 decreases, and as a result, the actual fuel injection amount gradually approaches the required injection amount.

According to the configurations and actions described above, following effects can be obtained.

The reference fall detection period T3r is a measured value, and therefore includes the effect of the variation in the current value detected by the current detection circuit 42. The reference fall calculation period T3c, on the other hand, is a value from which the effect of the variation in the current value detected by the current detection circuit 42 has been excluded to a certain extent. Hence, the reference fall calculation period T3c is a more precise value than the reference fall detection period T3r. The injection invalid period TA is calculated on the basis of the reference fall calculation period T3c, and therefore the injection invalid period TA can be calculated with a high degree of precision. As a result, the energization period TI can be set at an appropriate value for the required injection amount.

Further, in the control apparatus 10 for a fuel injection valve according to this embodiment, the variation ratio learned value Rc is calculated using the reference fall detection period T3r. The learned rise detection period T1r extending from the energization start point to the point at which the excitation current Iinj exceeds the learning current value I_Th1 is then measured during fuel injection by the fuel injection valve 20. The injection invalid period TA is then calculated on the basis of the learned calculation period T4c, which is obtained by multiplying the variation ratio learned value Rc by the measured learned rise detection period T1r. The learning current value I_Th1 is set such that the excitation current Iinj can always exceed the learning current value T_Th1 even when the required injection amount set in relation to the fuel injection valve 20 is a minimum amount. Therefore, the injection invalid period TA can be calculated appropriately, and the energization period TI can be adjusted appropriately, even during a short fuel injection in which energization is terminated before the excitation current Iinj reaches the peak current value Ip.

When energization of the fuel injection valve 20 is terminated before the excitation current Iinj reaches the peak current value Ip, the reference fall detection period T3r cannot be detected, and it may therefore be impossible to calculate the variation ratio learned value Rc appropriately. When the calculated energization period TI is equal to or smaller than the peak arrival period TI_th, energization of the fuel injection valve 20 may be terminated before the excitation current Iinj reaches the peak current value Ip. Hence, when the calculated energization period TI is equal to or smaller than the peak arrival period TI_th, the variation ratio learned value Rc is not calculated. Therefore, the injection invalid period TA is less likely to be calculated using an imprecise variation ratio learned value Rc, and as a result, a reduction in the calculation precision of the injection invalid period TA can be suppressed.

The correlative relationship between the excitation current increase speed at which the excitation current Iinj increases toward the peak current value Ip and the excitation current decrease speed at which the excitation current Iinj decreases from the peak current value Ip may vary according to the magnitude of the set peak current value Ip. Hence, in the control apparatus 10 for a fuel injection valve according to this embodiment, calculation of the variation ratio learned value Rc is permitted only when the peak current value Ip is set at the peak set value Ipa. In so doing, the variation ratio learned value Rc can be calculated by preparing only values based on the peak set value Ipa as the reference conversion coefficient A used to calculate the reference rise calculation period T2c and the learning conversion coefficient B used to calculate the learned rise calculation period T1c. There is therefore no need to prepare a plurality of reference conversion coefficients A and a plurality of learning conversion coefficients B, and as a result, a storage capacity of the memory required to store the coefficients can be reduced.

Further, during a fuel injection performed when calculation of the variation ratio learned value Rc is not yet complete, the injection invalid period TA is calculated using the preset initial value Rcb of the variation ratio learned value. The injection invalid period TA calculated in this manner is longer than the actual injection invalid period, and therefore the actual fuel injection amount can be prevented from falling below the required injection amount.

During a fuel injection performed after learning of the variation ratio learned value Rc is complete, the calculated value Rd that is multiplied by the learned rise detection period T1r during calculation of the injection invalid period TA approaches the variation ratio learned value Rc gradually from the initial value Rcb of the variation ratio learned value every time fuel is injected from the fuel injection valve 20. Therefore, when a difference between the initial value Rcb of the variation ratio learned value and the calculated variation ratio learned value Rc is large, the injection invalid period TA is modified gradually. As a result, rapid variation in the fuel injection amount during a switch in the variation ratio learned value from the initial value to the calculated value can be suppressed.

Incidentally, when the operating condition of the internal combustion engine (the engine) corresponds to the injection prohibited condition, fuel is not injected by the fuel injection valve 20. Therefore, a cooling action accompanying fuel injection does not occur, and as a result, the temperature of the fuel injection valve 20 may increase. In this case, the resistance value of the solenoid 21 of the fuel injection valve 20 increases, making it more difficult for the fuel injection valve 20 to open. Hence, in the control apparatus 10 for a fuel injection valve according to this embodiment, when the operating condition of the internal combustion engine (the engine) shifts from the injection prohibited condition to the injection permitted condition, the previous learned calculation period T4cb is obtained by multiplying the variation ratio learned value Rc by the last learned rise detection period T1r to be detected when the internal combustion engine (the engine) was previously in the injection permitted condition. A sum is then calculated by adding the temperature correction value Ytmp to a value corresponding to the previous learned calculation period T4cb, whereupon the injection invalid period TA is calculated on the basis of the calculated sum. Thus, during a fuel injection performed immediately after a shift to the injection permitted condition, the injection invalid period TA can be calculated while taking into account the temperature increase that occurred in the fuel injection valve 20 while fuel injection was prohibited, even though the excitation current Iinj has not been detected by the current detection circuit 42.

Note that the temperature correction amount Ytmp increases steadily as the injection valve temperature variation amount ΔTMP, which is the amount by which the temperature of the fuel injection valve 20 increased while the internal combustion engine (the engine) was in the injection prohibited condition, increases. Accordingly, the injection invalid period TA can be lengthened steadily as the injection valve temperature variation amount ΔTMP increases such that the fuel injection valve 20 opens less easily. As a result, the injection invalid period TA can be calculated in accordance with variation in an opening characteristic of the fuel injection valve 20 corresponding to the temperature increase.

The resistance value of the solenoid 21 of the fuel injection valve 20 varies according to the temperature of the solenoid 21, and therefore the injection characteristic of the fuel injection valve 20 may vary in accordance with the temperature of the environment in which the fuel injection valve 20 is disposed. In other words, when the variation ratio learned value Rc is calculated under various conditions having different disposal environment temperatures, the variation ratio learned value Rc varies according to the disposal environment temperature at the time of calculation.

Further, when a large amount of time has not yet elapsed following engine startup, the engine temperature remains in the vicinity of the outside air temperature, and therefore the engine temperature is likely to be included in a fixed temperature range from which the outside air temperature can be obtained. Hence, when the variation ratio learned value Rc is calculated before the elapse of a predetermined period following engine startup, the injection invalid period TA is calculated using a variation ratio learned value Rc in which variation caused by the disposal environment temperature has been suppressed, and as a result, the calculation precision can be improved.

When energization of the fuel injection valve 20 by the capacitor 12 is terminated, the capacitor voltage Vc is restored by charging from the battery 30. However, a request to start fuel injection may be issued during restoration of the capacitor voltage Vc. In this case, the fuel injection valve 20 opens less easily than during a fuel injection performed after the capacitor voltage Vc is restored.

Further, the capacity of the capacitor 12 varies according to individual differences occurring during manufacture of the capacitor 12, variation in the capacitor 12 over time, and so on. Therefore, even when the capacitor voltage Vc is at an upper limit voltage corresponding to the capacity thereof at that time, the ease with which the fuel injection valve 20 opens may vary in accordance with the capacity of the capacitor 12 at that time.

Hence, in the control apparatus 10 for a fuel injection valve according to this embodiment, the capacitor voltage correction value Yc is increased steadily as the capacitor voltage Vc at the energization start point decreases, whereupon the learned rise calculation period T1c is corrected using the capacitor voltage correction value Yc. In so doing, the learned rise calculation period T1c is shortened steadily as the capacitor voltage Vc at the energization start point decreases. By calculating the variation ratio learned value Rc using the learned rise calculation period T1c corrected in this manner, the variation ratio learned value Rc can be calculated while minimizing the effect of the capacitor voltage Vc. As a result, by calculating the injection invalid period TA using the variation ratio learned value Rc, a reduction in calculation precision can be suppressed.

When the measured learned rise detection period T1r is not included in the allowable range, the learned rise detection period measured during the previous fuel injection is obtained as the previous learned rise detection period T1rb. The learned calculation period T4c is then calculated by multiplying the variation ratio learned value Rc by the previous learned rise detection period T1rb, whereupon the abnormality determination correction value Yu, or in other words a predetermined value, is added to the learned calculation period T4c. The injection invalid period TA is then calculated on the basis of the resulting sum. As a result, a situation in which the injection invalid period TA becomes longer than the actual injection invalid period such that the actual fuel injection amount is smaller than the required injection amount can be suppressed.

When the difference between the reference rise detection period T2r and the reference fall detection period T3r is equal to or smaller than the noise determination value ΔTn, this may indicate erroneous detection of the reference fall detection point and so on due to noise superimposed on the excitation current Iinj, and therefore the variation ratio learned value Rc is calculated using the previous reference rise calculation period and the previous reference fall calculation period. As a result, a situation in which a divergence between the calculated injection invalid period TA and the actual injection invalid period increases due to the effect of erroneous detection of the reference fall detection point and so on due to noise superimposed on the excitation current Iinj can be suppressed.

The fuel injection valve 20 opens less easily as the fuel pressure in the delivery pipe 54 increases, and therefore the injection invalid period TA lengthens as the injection fuel pressure Pinj increases. Hence, the injection invalid period TA can be calculated in accordance with an opening characteristic of the fuel injection valve 20 corresponding to variation in the fuel pressure in the delivery pipe 54.

Note that the injection fuel pressure Pinj is calculated by adding the fuel pressure increase value ΔP, which increases as the amount of fuel discharged by the high pressure fuel pump 53 over the period from the detection point of the fuel pressure sensor value Pr to the energization start point, to the fuel pressure sensor value Pr. Therefore, even when a fuel injection is performed in an interval between the fuel pressure detection periods of the fuel pressure sensor 43, the injection fuel pressure Pinj can be calculated with a high degree of precision, taking into account the increase in the fuel pressure over the period from the point at which the fuel pressure sensor value Pr is detected by the fuel pressure sensor 43 to the energization start point. By calculating the injection invalid period TA using the injection fuel pressure Pinj, the calculation precision can be improved.

Note that the embodiment described above may be modified to other embodiments described below.

A method of calculating the fuel pressure increase value ΔP by determining the fuel pressure increase value ΔP on the basis of the amount of fuel discharged from the high pressure fuel pump 53 over the period from the detection point of the fuel pressure sensor value Pr to the energization start point was described above, but as long as variation in the fuel pressure in the delivery pipe 54 from the detection point of the fuel pressure sensor value Pr to the energization start point can be estimated, any other method may be employed.

The injection fuel pressure Pinj may be set at the last fuel pressure sensor value Pr to be detected by the fuel pressure sensor 43. In this case, the precision with which the fuel pressure correction coefficient Zp is set on the basis of the injection fuel pressure Pinj is slightly lower than that of the above embodiment, but a control load required to calculate the injection fuel pressure Pinj can be reduced.

When calculating the injection invalid period TA, instead of multiplying the fuel pressure correction coefficient Zp corresponding to the injection fuel pressure Pinj by the learned calculation period T4c, a correction value set at a value that increases as the injection fuel pressure Pinj increases may be determined, and the injection invalid period TA may be calculated by adding this correction value to the learned calculation period T4c. The injection invalid period TA can be lengthened as the injection fuel pressure Pinj increases likewise when this control configuration is employed.

When the variation in the opening characteristic of the fuel injection valve 20 corresponding to the injection fuel pressure Pinj is extremely small, the injection invalid period TA may be calculated without taking the injection fuel pressure Pinj into account.

When the difference between the reference rise detection period T2r and the reference fall detection period T3r is equal to or smaller than the noise determination value ΔTn, calculation of the variation ratio learned value Rc may be prohibited. In this case, when the difference between the reference rise detection period T2r and the reference fall detection period T3r exceeds the noise determination value ΔTn from a subsequent fuel injection onward, the variation ratio learned value Rc is preferably calculated using the respective detection periods T2r, T3r.

When the learned rise detection period T1r is not included in the allowable range, the injection invalid period TA may be set at a preset abnormal injection invalid period. Note that in accordance with the characteristics of the fuel injection valve 20 and the control apparatus 10, the abnormal injection invalid period preferably takes a larger value than a maximum calculable value of the injection invalid period. In so doing, the actual fuel injection amount can be prevented from falling below the required injection amount even when an abnormality occurs such that the learned rise detection period T1r is not included in the allowable range.

As long as the variation ratio learned value Rc can be calculated on the basis of the capacitor voltage Vc at the energization start point, the learned rise calculation period T1c may be corrected using a method other than the method of correcting the learned rise calculation period T1c on the basis of the capacitor voltage correction value Yc corresponding to the capacitor voltage Vc at the energization start point. For example, a correction coefficient that increases as the capacitor voltage Vc at the energization start point decreases may be determined, and the learned rise calculation period T1c may be corrected by multiplying this correction coefficient by the learned rise calculation period T1c. Likewise when this control configuration is employed, the learned rise calculation period T1c decreases steadily as the capacitor voltage Vc at the energization start point decreases, and as a result, the variation ratio learned value Rc can be calculated while minimizing the effect of the capacitor voltage Vc.

As long as it is possible to permit calculation of the variation ratio learned value Rc only when the engine temperature is within a predetermined temperature range, a method other than the method of permitting calculation of the variation ratio learned value Rc only when a predetermined amount of time has yet to elapse following engine startup may be employed. For example, the engine temperature may be estimated on the basis of a water temperature of cooling water that circulates in the internal combustion engine (the engine) or the like, and calculation of the variation ratio learned value Rc may be permitted only when the engine temperature is included in a predetermined temperature range.

When calculation of the variation ratio learned value Rc is complete, the calculated value Rd may be switched from the initial value Rcb to the calculated value (i.e. the variation ratio learned value Rc) immediately. In this case, however, the injection invalid period TA varies rapidly at the time of the switch when the difference between the initial value Rcb and the learned variation ratio learned value Rc is large. Accordingly, the fuel injection amount varies rapidly in response to the rapid variation in the injection invalid period TA. To suppress this rapid variation in the fuel injection amount, a configuration in which the calculated value Rd approaches the variation ratio learned value Rc from the initial value Rcb of the variation ratio learned value gradually, as in the above embodiment, may be employed.

As long as the initial value Rcb of the variation ratio learned value is larger than the maximum calculable variation ratio learned value Rc, the initial value Rcb of the variation ratio learned value may take a value other than a value obtained by dividing the central characteristic value T1rmid by the minimum value T1rmin. For example, a value obtained by dividing the maximum value T1rmax by the minimum value T1rmin may be set as the initial value Rcb of the variation ratio learned value.

As long as the injection invalid period TA can be calculated on the basis of the reference fall calculation period T3c, a method other than the method of calculating the variation ratio learned value Rc and then calculating the injection invalid period TA using the variation ratio learned value Rc may be employed. For example, the resistance value of the solenoid 21 of the fuel injection valve 20 may be estimated to increase steadily as the reference fall calculation period T3c is longer. Therefore, a map showing a relationship between the reference fall calculation period T3c and the injection invalid period TA may be prepared in advance, and the injection invalid period TA corresponding to the reference fall calculation period T3c may be calculated using this map.

As long as the injection invalid period TA can be calculated on the basis of the reference fall detection period T3r, a method other than the method of calculating the variation ratio learned value Rc and then calculating the injection invalid period TA using the variation ratio learned value Rc may be employed. For example, the resistance value of the solenoid 21 of the fuel injection valve 20 may be estimated to increase steadily as the reference fall detection period T3r is longer. Therefore, a map showing a relationship between the reference fall detection period T3r and the injection invalid period TA may be prepared in advance, and the injection invalid period TA corresponding to the reference fall detection period T3c may be calculated using this map. Likewise in this case, the injection invalid period TA can be calculated with a higher degree of precision than when the injection invalid period TA is calculated on the basis of the increase speed of the excitation current Iinj at which the excitation current Iinj increases toward the peak current value Ip.

What is claimed is:

1. A control apparatus for a fuel injection valve, the control apparatus comprising:

a drive control unit that controls an opening and closing operation of the fuel injection valve by causing an excitation current to flow in a solenoid of the fuel injection valve;

a current detection circuit that detects the excitation current flowing in the solenoid; and an electronic control unit programmed to:

(a) calculate an injection standby period that is a period from an energization start point of the solenoid to a point at which the fuel injection valve opens;

(b) adjust an energization period of the solenoid in accordance with the injection standby period;

(c) measure a reference fall detection period that is a period from the energization start point to a reference fall detection point, the reference fall detection point being a point at which the excitation current detected by the current detection circuit falls below a reference current value that is smaller than a peak current value, while the excitation current decreases after the excitation current reaches the peak current value; and (d) set the injection standby period to be longer as the reference fall detection period is longer, wherein the peak current value is a value that is set as a current value at which the fuel junction valve opens reliably.

2. The control apparatus for a fuel injection valve according to claim 1, wherein the electronic control unit is programmed to measure a reference rise detection period that is a period from the energization start point to a reference rise detection point, and calculate a reference rise calculation period by multiplying a reference conversion coefficient by the reference fall detection period, the reference rise detection point being a point at which the excitation current detected by the current detection circuit exceeds the reference current value while the excitation current increases toward the peak current value, and the reference rise calculation period being a calculated value of the period from the energization start point to the reference rise detection point, the electronic control unit is programmed to increase a reference fall variation ratio steadily as a reference rise variation ratio increases, the reference rise variation ratio is a quotient obtained by dividing the reference rise calculation period by the reference rise detection period, and the electronic control unit is programmed to calculate a reference fall calculation period by multiplying the reference fall variation ratio by the reference fall detection period, and set the injection standby period to be longer as the reference fall calculation period is longer.

3. The control apparatus for a fuel injection valve according to claim 2, wherein the electronic control unit is programmed to measure a learned rise detection period that is a period from the energization start point to a learned rise detection point, the learned rise detection point being a point at which the excitation current detected by the current detection circuit equals or exceeds a learning current value that is smaller than the reference current value, while the excitation current increases toward the peak current value, the electronic control unit is programmed to calculate a learned rise calculation period that is a calculated value of the period from the energization start point to the learned rise detection point, by multiplying a learning conversion coefficient by the reference fall calculation period, the electronic control unit is programmed to calculate a variation ratio learned value by dividing the learned rise calculation period by the learned rise detection period, and the electronic control unit is programmed to measure the learned rise detection period during a fuel injection, and set the injection standby period to be longer as a product obtained by multiplying the variation ratio learned value by the learned rise detection period increases.

4. The control apparatus for a fuel injection valve according to claim 3, wherein the electronic control unit is programmed not to calculate the variation ratio learned value when energization of the fuel injection valve is terminated before the excitation current detected by the current detection circuit reaches the peak current value.

5. The control apparatus for a fuel injection valve according to claim 3, wherein the electronic control unit is programmed not to calculate the variation ratio learned value when the energization period is smaller than a predetermined period.

6. The control apparatus for a fuel injection valve according to claim 4, wherein the electronic control unit is programmed to set a quotient obtained by dividing a central characteristic value of the learned rise detection period by a minimum measurable value of the learned rise detection period as an initial value of the variation ratio learned value, and the electronic control unit is programmed to set the injection standby period to be longer as a product obtained by multiplying the initial value of the variation ratio learned value by the learned rise detection period increases when calculation of the variation ratio learned value is not complete.

7. The control apparatus for a fuel injection valve according to claim 6, wherein the electronic control unit is programmed to cause the value that is multiplied by the learned rise detection period when determining the injection standby period to approach the variation ratio learned value from the initial value of the variation ratio learned value gradually every time fuel is injected from the fuel injection valve, after the variation ratio learned value has been calculated.

8. The control apparatus for a fuel injection valve according to claim 3, wherein the electronic control unit is programmed to calculate a product by multiplying the variation ratio learned value by the last learned rise detection period to be detected when an operating condition of an engine was previously in an injection permitted condition, and set the injection standby period to be longer as a value obtained by adding a temperature correction value to the product increases, when the operating condition of the engine shifts from an injection prohibited condition, in which fuel injection by the fuel injection valve is prohibited, to the injection permitted condition, in which fuel injection is performed by the fuel injection valve.

9. The control apparatus for a fuel injection valve according to claim 8, wherein the temperature correction value takes a larger value as an amount by which a temperature of the fuel injection valve increases while the condition of the engine is in the injection prohibited condition.

10. The control apparatus for a fuel injection valve according to claim 3, wherein the electronic control unit is programmed to calculate the variation ratio learned value when an engine temperature is included in a temperature range.

11. The control apparatus for a fuel injection valve according to claim 3, wherein the electronic control unit is programmed to calculate the variation ratio learned value before a fixed period elapses following engine startup.

12. The control apparatus for a fuel injection valve according to claim 3, the control apparatus including a battery, and the control apparatus further comprising a capacitor that is capable of applying a higher voltage than the battery, wherein the drive control unit is programmed to supply power to the solenoid of the fuel injection valve from the capacitor from the energization start point to a point at which the excitation current reaches the peak current value, and the electronic control unit is programmed to shorten the learned rise calculation period as a voltage of the capacitor at the energization start point decreases, and calculate the variation ratio learned value using the learned rise calculation period.

13. The control apparatus for a fuel injection valve according to claim 3, wherein the electronic control unit is programmed to calculate a product by multiplying the variation ratio learned value by the learned rise detection period measured during a previous fuel injection, and set the injection standby period to be longer as a value obtained by adding an abnormality determination correction value to the calculated product increases, when the learned rise detection period is not included in an allowable range.

14. The control apparatus for a fuel injection valve according to claim 3, wherein the electronic control unit is programmed to calculate the variation ratio learned value using the reference rise calculation period used to calculate the previous variation ratio learned value and the reference fall calculation period used to calculate the previous variation ratio learned value when a difference between the reference rise detection period and the reference fall detection period is equal to or smaller than a determination value.

15. The control apparatus for a fuel injection valve according to claim 1, wherein the electronic control unit is programmed to set the injection standby period to be longer as an injection fuel pressure increases, the injection fuel pressure being a fuel pressure in a delivery pipe at a point where fuel is injected from the fuel injection valve.

16. The control apparatus for a fuel injection valve according to claim 15, wherein the injection fuel pressure takes a value obtained by adding a fuel pressure increase amount to a fuel pressure sensor value detected by a fuel pressure sensor, and the fuel pressure increases steadily as an amount of fuel discharged from a fuel pump over a period from a detection point of the fuel pressure sensor value to the energization start point increases.

17. A method of controlling a fuel injection valve using an electronic control unit, the control method comprising:

controlling an opening and closing operation of the fuel injection valve by causing an excitation current to flow in a solenoid of the fuel injection valve;

detecting the excitation current flowing in the solenoid;

calculating an injection standby period that is a period from an energization start point of the solenoid to a point at which the fuel injection valve opens;

adjusting an energization period of the solenoid in accordance with the injection standby period;

measuring a reference fall detection period that is a period from the energization start point to a reference fall detection point, wherein the reference fall detection point is a point at which the excitation current detected by the current detection circuit falls below a reference current value that is smaller than a peak current value, while the excitation current decreasing after reaching the peak current value, and the peak current value is a value that is set as a current value at which the fuel junction valve opens reliably; and setting the injection standby period to be longer as the reference fall detection period is longer.

* * * * *